US007242782B1

(12) United States Patent
Kasai et al.

(10) Patent No.: US 7,242,782 B1
(45) Date of Patent: Jul. 10, 2007

(54) AUDIO SIGNAL PROCESSING CIRCUIT

(76) Inventors: Joji Kasai, c/o Onkyo Corporation, 2-1, Nisshin-cho, Neyagawa-shi, Osaka 572-8540 (JP); Kazumasa Takemura, c/o Onkyo Corporation, 2-1, Nisshin-cho, Neyagawa-shi, Osaka 572-8540 (JP); Tetsuro Nakatake, c/o Onkyo Corporation, 2-1, Nisshin-cho, Neyagawa-shi, Osaka 572-8540 (JP)

( * ) Notice: Subject to any disclaimer, the term of this patent is extended or adjusted under 35 U.S.C. 154(b) by 0 days.

(21) Appl. No.: 09/361,734

(22) Filed: Jul. 28, 1999

(30) Foreign Application Priority Data

Jul. 31, 1998 (JP) ..... 10-217929
Jul. 31, 1998 (JP) ..... 10-218218

(51) Int. Cl.
*H04R 1/40* (2006.01)
*H04R 5/00* (2006.01)

(52) U.S. Cl. ..... 381/97; 381/1

(58) Field of Classification Search ..... 381/1, 381/17, 18, 97
See application file for complete search history.

(56) References Cited

U.S. PATENT DOCUMENTS 4,817,162 A 3/1989 Kihara ..... 381/97
5,033,092 A 7/1991 Sadaie ..... 381/97
5,579,396 A 11/1996 Iida et al. ..... 381/18
5,761,315 A 6/1998 Iida et al. ..... 381/18
5,799,094 A 8/1998 Mouri ..... 381/18
5,892,831 A * 4/1999 Schott ..... 381/1

FOREIGN PATENT DOCUMENTS

JP 49/48961 12/1974
JP 8-51698 2/1996
JP 8-205297 8/1996
JP 8-336199 12/1996
JP HEI 08-182097 12/1996
JP HEI 09-065497 7/1997

OTHER PUBLICATIONS

Abstract of Japanese Patent Publication No. 8-265899 Dated Oct. 11, 1996 Copy Of Partial European Search Report Dated Oct. 14, 2004.

* cited by examiner

*Primary Examiner*—Xu Mei

(57) ABSTRACT

An audio signal processing circuit for an audio reproduction apparatus at least having sound source located substantially at left and right sides to a listener, is provided. The audio signal processing circuit includes a phase difference control portion. The phase difference control portion receives a left channel signal for the left sound source and a right channel signal for the right sound source, controls a phase difference between the left and right channel signals so as to produce a relative phase difference in the range of 140 degrees to 160 degrees, and outputs the phase difference controlled left and right channel signals for the left and right sound source, respectively.

9 Claims, 29 Drawing Sheets

Hsum:32tap
Hdif:128tap

IMPULSE RESPONSE REQUIRED FOR FILTER

OPTIMUMLY APPROXIMATED IIR FILTER
IMPULSE RESPONSE

COMPARISON BETWEEN h(n) AND g(n-k) IN THE RANGE OF $0 \leqq n \leqq m$

AUDIO SIGNAL PROCESSING CIRCUIT

CROSS-REFERENCE TO RELATED APPLICATIONS

The disclosure of Japanese Patent Application Nos. Hei 10-217929 and Hei 10-218128 both filed on Jul. 31, 1998 including specification, claims, drawings and summary is herein incorporated by reference in its entirety.

BACKGROUND OF THE INVENTION

1. Field of the Invention

The present invention relates to an audio signal processing circuit in a so-called surround system. More particularly, the present invention relates to simplification of its structure, improvement of accuracy, and localization of sound image.

2. Description of the Related Art

Recently, an audio reproduction apparatus having surround channels at a left and a right sides to a listener in addition to a left and a right (and optionally a center) front channels, has been developed not only for business use but also for home use. In the surround reproduction utilizing such apparatus, two of surround speakers are usually arranged at the both sides (i.e., left and right sides) to the listener. When the correlation between the left and the right surround signals is small (i.e., when a stereophonic surround system is employed), the listener does not have an unnatural feeling. In contrast, when the correlation between the left and the right surround signals is large (i.e., when a monophonic surround system is employed), the following problem is recognized depending on the listener's position. Specifically, when the listener is positioned at the center between the left and the right surround speakers, the listener has an unnatural feeling as if sound image was localized in the head of the listener.

In order to solve the above-mentioned problem, a technique alternatively dividing a monophonic signal into two channels with respect to each frequency component of predetermined width by using a comb type filter so as to virtually reproduce stereophonic sound, a technique performing a pitch shift processing so as to reduce the correlation (e.g., THX system), and a technique performing a 90 degrees phase shift processing so as to make the correlation zero, have been proposed.

However, the above-mentioned techniques have the following problems, respectively.

According to the technique using the comb type filter so as to virtually reproduce stereophonic sound, unnaturally large sound is often reproduced when a musical instrument is used as sound source. Furthermore, the virtual stereophonic sound reproduction compromises the sound quality when the surround signals are stereophonic. Therefore, it is necessary to prevent the stereophonic sound reproduction in such a case. As a result, a change of a processing mode is required depending upon whether the surround signals are monophonic or stereophonic, which makes the overall processing complicated.

According to the technique performing the pitch shift processing such as THX system, there has been a tradeoff problem that the large amount of the pitch shift is required for reducing the correlation and that the large amount of the pitch shift lowers the sound quality. Furthermore, similar to the virtual stereophonic sound reproduction, a change of a processing mode is required depending upon whether the surround signals are monophonic or stereophonic, which makes the overall processing complicated.

The technique performing the 90 degrees phase shift processing is superior to the above-described techniques in view of the fact that the sound quality is not lowered in the case of the stereophonic surround signals and that a change of a processing mode is not required. However, sound image is apt to be localized in the direction of the channel whose phase relatively progresses, which provides the listener with an unnatural feeling. This problem is especially remarkable in the case where the left and the right surround sound sources are virtual sound sources.

As described above, an apparatus and a method, which are capable of performing the same processing independent of whether the surround signals are monophonic or stereophonic, preventing sound image localization in the head of the listener so as to create sound field just as enveloping the listener, and performing a processing which does not compromise the sound quality even when the surround signals are stereophonic, are eagerly demanded.

By the way, an audio signal processing circuit disclosed in Japanese Laid-open Publication No. Hei 8-265899 (265899/1996) is shown in FIG. 29. The circuit is used for making a listener 102 to feel that sound image reproduced by virtual speakers XL and XR is virtually localized at rear sides to the listener 102. By utilizing the circuit, the listener is able to feel that he/she is surrounded by the sound reproduced with the speakers 104L and 104R as well as surrounded by the sound reproduced with the virtual speakers XL and XR even when the speakers 104L and 104R are actually arranged only in front of the listener 102.

In the apparatus shown in FIG. 29, a total of four filters 106*a*, 106*b*, 106*c* and 106*d* are used for performing the above-mentioned sound image localization. Transfer functions H11, H12, H21 and H22 of the respective filters are represented by the following equations:

$$H11=(h_{RR}h_{L'L}-h_{RL}h_{L'R})/(h_{LL}h_{RR}-h_{LR}h_{RL})$$

$$H12=(h_{LL}h_{L'R}-h_{LR}h_{L'L})/(h_{LL}h_{RR}-h_{LR}h_{RL})$$

$$H21=(h_{RR}h_{R'L}-h_{RL}h_{R'R})/(h_{LL}h_{RR}-h_{LR}h_{RL})$$

$$H22=(h_{LL}h_{R'R}-h_{LR}h_{R'L})/(h_{LL}h_{RR}-h_{LR}h_{RL})$$

Here, $h_{LL}$ is a transfer function from the speaker 104L to the left ear 102L of the listener 102, $h_{LR}$ is a transfer function from the speaker 104L to the right ear 102R of the listener 102, $h_{RL}$ is a transfer function from the speaker 104R to the left ear 102L of the listener 102, and $h_{RR}$ is a transfer function from the speaker 104R to the right ear 102R of the listener 102.

Equations $h_{LL}=h_{RR}$, $h_{LR}=h_{RL}$, $h_{L'L}=h_{R'R}$ and $h_{L'R}=h_{R'L}$ are satisfied in the equations stated above when the speakers 104L and 104R and the virtual speakers XL and XR are symmetrically arranged with respect to a central axis 108 through the listener 102. As a result, equations H11=H22 and H12=H21 can be derived, so that the circuit can be obtained by utilizing total of two filters as shown in FIG. 30 (such structure is referred to as "shuffler type filter"). Here, transfer functions $H_{SUM}$ of the filters 110*a* and $H_{DIF}$ of the filters 110*b* are represented by the following equations:

$$H_{SUM}=(ha'+hb')/2(ha+hb)$$

$$H_{DIF}=(ha'-hb')/2(ha-hb)$$

wherein equations $ha=h_{LL}=h_{RR}$, $hb=h_{LR}=h_{RL}$, $ha'=h_{L'L}=h_{R'R}$ and $hb'=h_{L'R}=h_{R'L}$ are satisfied.

As described above, in the case where the speakers are symmetrically arranged, sound image can be localized at the virtual speaker positions with the simple circuit.

Furthermore, a method for localizing sound image by utilizing a cross-feed filter 112 and a cross-talk cancel filter 114 as shown in FIG. 31, has been proposed. The cross-talk cancel filter 114 functions to cancel cross-talk from the right speaker 104R to the left ear 102L of the listener and that from the left speaker 104L to the right ear 102R of the listener. Accordingly, the cross-talk cancel filter 114 makes it possible that a left channel signal L reaches only the left ear 102L and a right channel signal R reaches only the right ear 102R. As a result, sound image can be localized at the desired position by adjusting the amount of the cross-talk with the cross-talk cancel filter 114.

The above-mentioned cross-talk cancel filter 114 can also be obtained by utilizing the shuffler type filter as shown in FIG. 30. In this case, transfer functions $H_{SUM}$ of the filters 110*a* and $H_{DIF}$ of the filters 110*b* are represented by the following equations:

$$H_{SUM}=ha/(2(ha+hb))$$

$$H_{DIF}=ha/(2(ha-hb)).$$

According to the shuffler type filter, a circuit having satisfactory sound image localization ability or satisfactory cross-talk cancel ability can be obtained only when the filters 110*a* and 110*b* are highly accurate. However, in order to make the filters accurate, the structure thereof becomes complicated. As a result, when a digital signal processor (DSP) is employed for the filters, it takes much time to perform a sound image localization processing or a cross-talk cancel processing. In contrast, when the structure of the filters is simple, the ability of the filters is insufficient.

As described above, a shuffler type filter having a simple structure and a high accuracy is eagerly demanded for a surround system.

SUMMARY OF THE INVENTION

An audio signal processing circuit according to the present invention is used for an audio reproduction apparatus at least having sound source located substantially at left and right sides to a listener. The audio signal processing circuit includes a phase difference control portion. The phase difference control portion receives a left channel signal for the left sound source and a right channel signal for the right sound source, controls a phase difference between the left and right channel signals so as to produce a relative phase difference in the range of 140 degrees to 160 degrees, and outputs the phase difference controlled left and right channel signals for the left and right sound source, respectively.

The phase difference of 60 degrees causes the problem that sound image is localized in the direction of the channel whose phase relatively progresses, as in the case of the 90 degrees phase shift processing. The phase difference of 180 degrees (i.e., inverse phase) causes a listener unpleasant feeling as if the ear of the listener is pressurized, which problem is unique to the inverse phase. In contrast, the phase difference of 140 to 160 degrees does not cause an unpleasant feeling unique to the inverse phase or produces sound image localization in the certain direction. As a result, the present invention can prevent sound image of the monophonic signal from localizing in the head of the listener so as to create sound field just as enveloping the listener.

Furthermore, since only the phase difference control operation is additionally performed according to the present invention, the audio reproduction according to the present invention does not compromise the sound quality even when the stereophonic signal is employed. As a result, according to the present invention, the same processing can be performed independent of whether the input signal is monophonic or stereophonic.

In one embodiment of the invention, the phase difference control portion produces the relative phase difference of 140 degrees to 160 degrees in a frequency region ranging from 200 Hz to 1 kHz. Accordingly, the phase difference control can be effectively performed while the structure of the phase difference control portion is made simple.

According to another aspect of the present invention, a surround audio reproduction apparatus having a left and a right channels in front of a listener and a left and a right surround channels at left and right sides with respect to the listener, is provided. The apparatus includes a phase difference control portion. The phase difference control portion receives a left surround channel signal and a right surround channel signal, controls a phase difference between the left and the right surround channel signals so as to produce a relative phase difference in the range of 140 degrees to 160 degrees, and outputs the phase difference controlled surround left and right channel signals for a left and a right surround sound source, respectively. Accordingly, an audio reproduction apparatus capable of performing the same processing independent of whether the input signals are monophonic or stereophonic, preventing sound image localization in the head of the listener so as to create sound field just as enveloping the listener, and performing a processing which does not compromise the sound quality even when the surround signals are stereophonic, can be obtained.

In one embodiment of the invention, the left and the right surround sound sources are a virtual sound source produced by a sound image localization processing.

In another embodiment of the invention, the phase difference control portion produces the relative phase difference of 140 degrees to 160 degrees in a frequency region ranging from 200 Hz to 1 kHz. Accordingly, the phase difference control can be effectively performed while the structure of the phase difference control portion is made simple.

According to another aspect of the present invention, an audio reproduction method at least utilizing sound source located substantially at left and right sides to a listener, is provided. The method includes the steps of: controlling a phase difference between a left channel signal for the left sound source and a right channel signal for the right sound source so as to produce a relative phase difference in the range of 140 degrees to 160 degrees; and outputting the phase difference controlled left and right channel signals for the left and right sound source, respectively.

According to still another aspect of the present invention, a shuffler type audio signal processing circuit is provided. The shuffler type audio signal processing circuit includes a first filter for producing a sum signal of a left channel signal and a right channel signal; and a second filter for producing a differential signal of the left channel signal and the right channel signal. In a shuffler type audio signal processing circuit, a gain of the second filter is higher than that of the first filter in a low frequency region. Accordingly, by making an accuracy of the second filter higher than that of the first filter in a low frequency region, the structure of the circuit can be simplified while a reduction of accuracy is prevented.

According to still another aspect of the present invention, a shuffler type audio signal processing circuit is provided.

The shuffler type audio signal processing circuit includes a first filter for producing a sum signal of a left channel signal and a right channel signal; and a second filter for producing a differential signal of the left channel signal and the right channel signal, wherein the first filter and the second filter are FIR filter, and the tap number of the second filter is larger than that of the first filter. Accordingly, the structure of the circuit can be simplified while a reduction of accuracy is prevented.

In one embodiment of the invention, the second filter is composed of a filter bank. Accordingly, a processing margin can be increased by performing down-sampling.

In another embodiment of the invention, the filter bank performs down-sampling by the larger number for the lower frequency component. Accordingly, an accuracy of the second filter is made higher than that of the first filter in a low frequency region, so that the structure of the circuit can be simplified while a reduction of accuracy is prevented.

According to still another aspect of the present invention, a shuffler type audio signal processing circuit is provided. The shuffler type audio signal processing circuit includes a first filter for producing a sum signal of a left channel signal and a right channel signal; and a second filter for producing a differential signal of the left channel signal and the right channel signal, wherein the first filter is FIR filter and the second filter is composed of a parallel connection of FIR filter and secondary IIR filter. Accordingly, an accuracy of the second filter is made higher than that of the first filter in a low frequency region, so that the structure of the circuit can be simplified while a reduction of accuracy is prevented. Furthermore, since a low frequency component can be processed with the secondary IIR filter, unnecessary increase of the tap number of the FIR filter can be prevented.

In one embodiment of the invention, the second filter includes: FIR filter, and secondary IIR filter connected in parallel to the FIR filter at one of the intermediate taps or the end tap thereof. Accordingly, an accuracy of the second filter is made higher than that of the first filter in a low frequency region, so that the structure of the circuit can be simplified while a reduction of accuracy is prevented. Furthermore, by varying an intermediate tap connected to the secondary IIR filter, optimum properties for the filter can be obtained.

In one embodiment of the invention, the circuit is used as a cross-talk cancel filter.

In one embodiment of the invention, the circuit is used as a sound image localization processing filter.

According to still another aspect of the present invention, a filter is provided. The filter includes: FIR filter having a plurality of taps, IIR filter whose input is connected to one of the intermediate taps or the end tap of the FIR filter, and an adding means which adds outputs of the FIR filter and the IIR filter. Accordingly, a filter having desired properties can be obtained.

According to still another aspect of the present invention, a shuffler type audio signal processing method is provided. The method includes the steps of: performing a first filtering process for a sum signal of a left channel signal and a right channel signal; and performing a second filtering process for a differential signal of the left channel signal and the right channel signal, wherein an accuracy of the second filtering process is higher than that of the first filtering process.

Thus, the invention described herein makes the possible the advantages of: (1) providing a processing capable of performing the same processing independent of whether the input signals are monophonic or stereophonic, preventing sound image localization in the head of the listener so as to create sound field just as enveloping the listener, and performing a processing which does not compromise the sound quality even when the surround signals are stereophonic; and (2) providing a shuffler type filter having a simple structure and a high accuracy.

These and other advantages of the present invention will become apparent to those skilled in the art upon reading and understanding the following detailed description with reference to the accompanying figures.

DETAILED DESCRIPTION OF THE PREFERRED EMBODIMENTS

Figure 1:
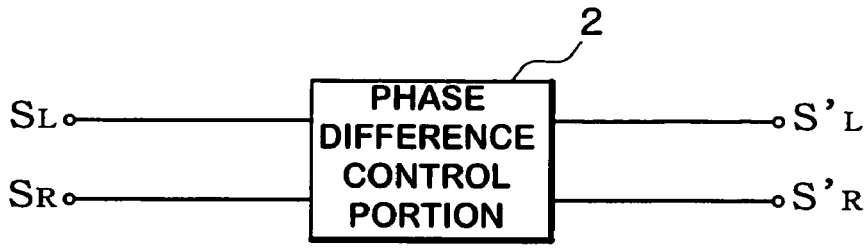
FIG. 1 is a block diagram of an audio signal processing circuit according to an embodiment of the present invention.

FIG. 1 is a block diagram of an audio signal processing circuit according to an embodiment of the present invention. The audio signal processing circuit includes a phase difference control portion 2. The phase difference control portion 2 receives a left channel signal $S_L$ for a left sound source $S_{SL}$ located substantially at a left side to a listener (shown in FIG. 5) and a right channel signal $S_R$ for a right sound source $S_{SR}$ located substantially at a right side to the listener (also shown in FIG. 5). The phase difference control portion 2 controls a phase difference between the left and right channel signals $S_L$ and $S_R$ so that the relative phase difference be from 140 degrees to 160 degrees (and preferably about 150 degrees) and outputs the phase difference controlled signals $S'_L$ and $S'_R$ for the left and right sound source, respectively.

The signals $S'_L$ and $S'_R$ processed in the above-mentioned manner are respectively supplied to the sound sources $S_{SL}$ and $S_{SR}$. As a result, with respect to a monophonic signal, the circuit is capable of preventing sound image localization in the head of the listener and creating sound field just as enveloping the listener. Furthermore, with respect to a stereophonic signal, the circuit is capable of performing a processing which does not compromise the sound quality (i.e., a feeling that sound image of the left and the right surround channels is comfortably localized).

Figure 2:
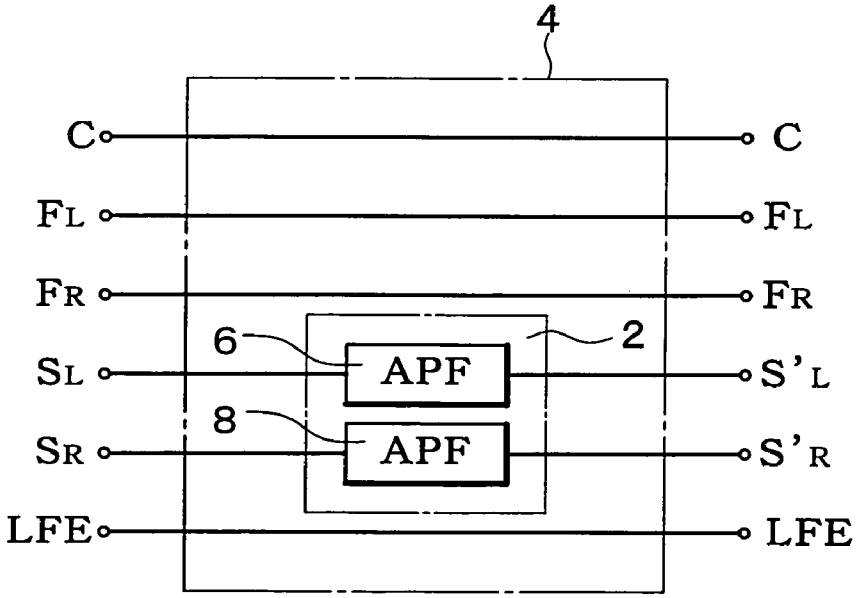
FIG. 2 is a block diagram of an audio reproduction apparatus wherein the audio signal processing circuit of FIG. 1 is incorporated.

FIG. 2 is a block diagram of an audio signal processing circuit 4 which is incorporated into an audio reproduction apparatus, wherein the phase difference control portion 2 includes all pass filters (APFs) 6 and 8. The apparatus includes an amplifier and speakers both of which are connected to the output of the audio signal processing circuit 4 (not shown in FIG. 2).

A central channel signal C, a front left channel signal $F_L$, a front right channel signal $F_R$, a surround left channel signal $S_L$, a surround right channel signal $S_R$, and a low frequency channel signal LFE are input to the circuit 4. Among these signals, The central channel signal C, the front left channel signal $F_L$, the front right channel signal $F_R$, and the low frequency channel signal LFE are output without any processing. The surround left channel signal $S_L$ is processed with the APF 6 so as to be output as the signal $S'_L$. The surround right channel signal $S_R$ is processed with the APF 8 so as to be output as the signal $S'_R$. In this embodiment, the APFs 6 and 8 constitute the phase difference control portion 2.

Figure 3A:
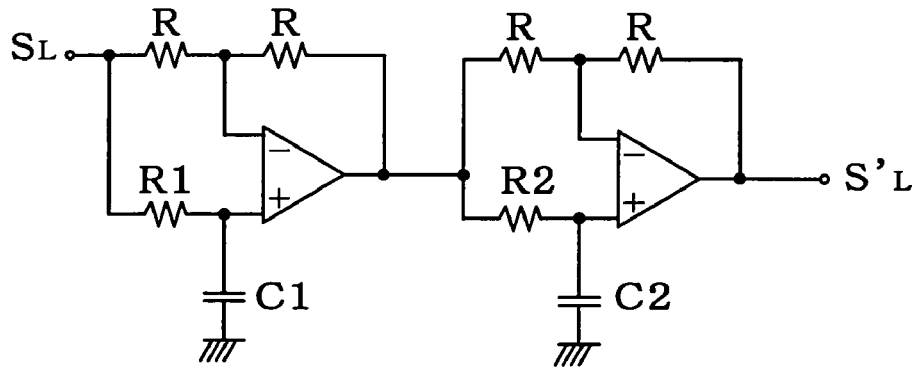
FIGS. 3A and 3B are circuit diagrams according to embodiments wherein an all pass filter used in the present invention is composed of an analog circuit.

An example of the APF 6 is shown in FIG. 3A. The example illustrates secondary APF. A frequency-phase relationship of the APF 6 is shown as a curved line 10 in FIG. 4. In a low frequency region, the phase of the output signal is the same as that of the input signal (i.e., the phase difference between the input and the output signals is zero). The phase of the output signal delays as the frequency increases, and in a high frequency region, the phase of the output signal becomes again the same as that of the input signal (i.e., the phase difference between the input and the output signals becomes 360 degrees). In other words, the phase difference between the input and the output signals varies in the range of zero to 360 degrees depending upon the frequency. The properties of the APF 6 represented by the curved line 10 may be adapted by selecting resistance R1 and R2 and capacitor C1 and C2.

A desired phase difference $\arg(S'_R/S'_L)$ is represented by the following equation:

$$\arg(S'_R/S'_L)=\arg(S'_R/S_R)-\arg(S'_L/S_L)$$

here, the following equations are satisfied:

$$\arg(S'_L/S_L)=\tan^{-1}((-2(f/f1))/(1-(f/f1)2))+\tan^{-1}((-2(f/f2))(1-(f/f2)2))$$

$$\arg(S'_R/S_R)=\tan^{-1}((-2(f/f3))/(1-(f/f3)2))+\tan^{-1}((-2(f/f4))/(1-(f/f4)2)$$

$$f1=1/(2\pi C1*R1)$$

$$f2=1/(2\pi C2*R2)$$

$$f3=1/(2\pi C3*R3)$$

$$f4=1/(2\pi C4*R4)$$

Therefore, the APF 6 having desired properties can be designed based on the above-mentioned equations.

Figure 3B:
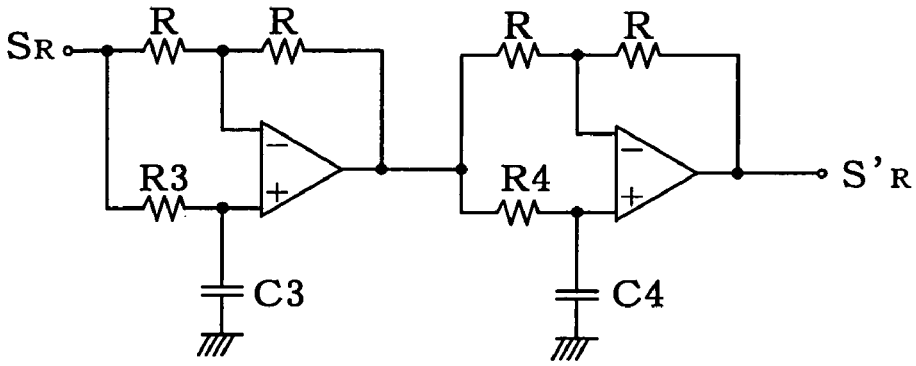
Figure 4:
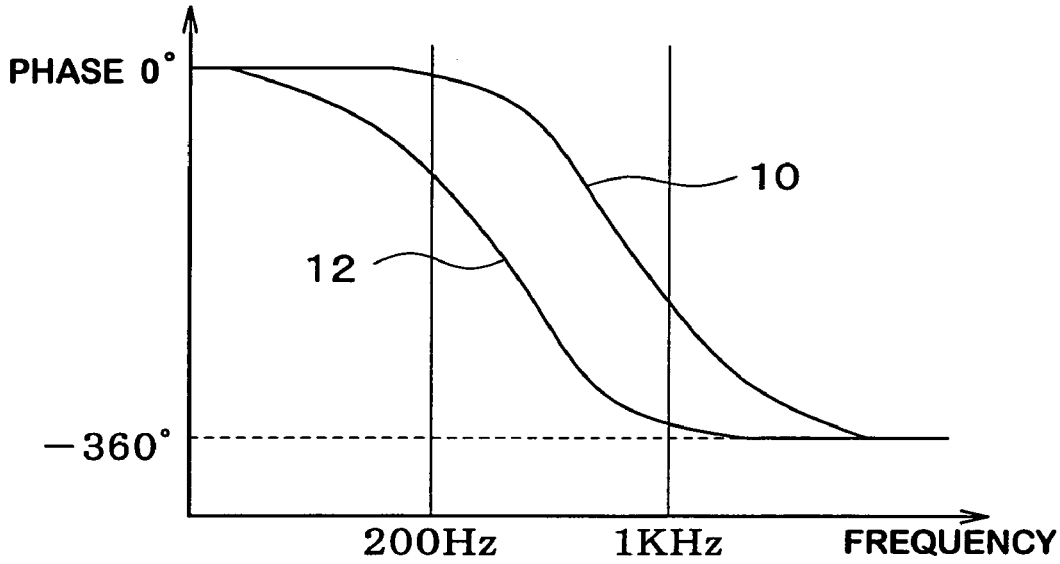
FIG. 4 is a graph illustrating a frequency-phase relationship of the all pass filter used in the present invention.

An example of the APF 8 is shown in FIG. 3B. The structure thereof is basically the same as that of the APF 6. The properties of the APF 8 represented by a curved line 12 of FIG. 4 are obtained by selecting resistance R3 and R4 and capacitor C3 and C4. By utilizing the above-mentioned APFs 6 and 8, the phase difference of 140 to 160 degrees can be obtained between the surround left channel signal $S'_L$ and the surround right channel signal $S'_R$ in a frequency region ranging from 200 Hz to 1 kHz. In other words, when the monophonic surround left channel signal $S_L$ and the monophonic surround right channel signal $S_R$ are supplied to the APFs 6 and 8, the APFs 6 and 8 can control the phase difference between the signals $S_L$ and $S_R$ so that the phase of the signal $S'_R$ relatively progresses or delays 140 to 160 degrees to that of the signal $S'_L$.

Figure 5:
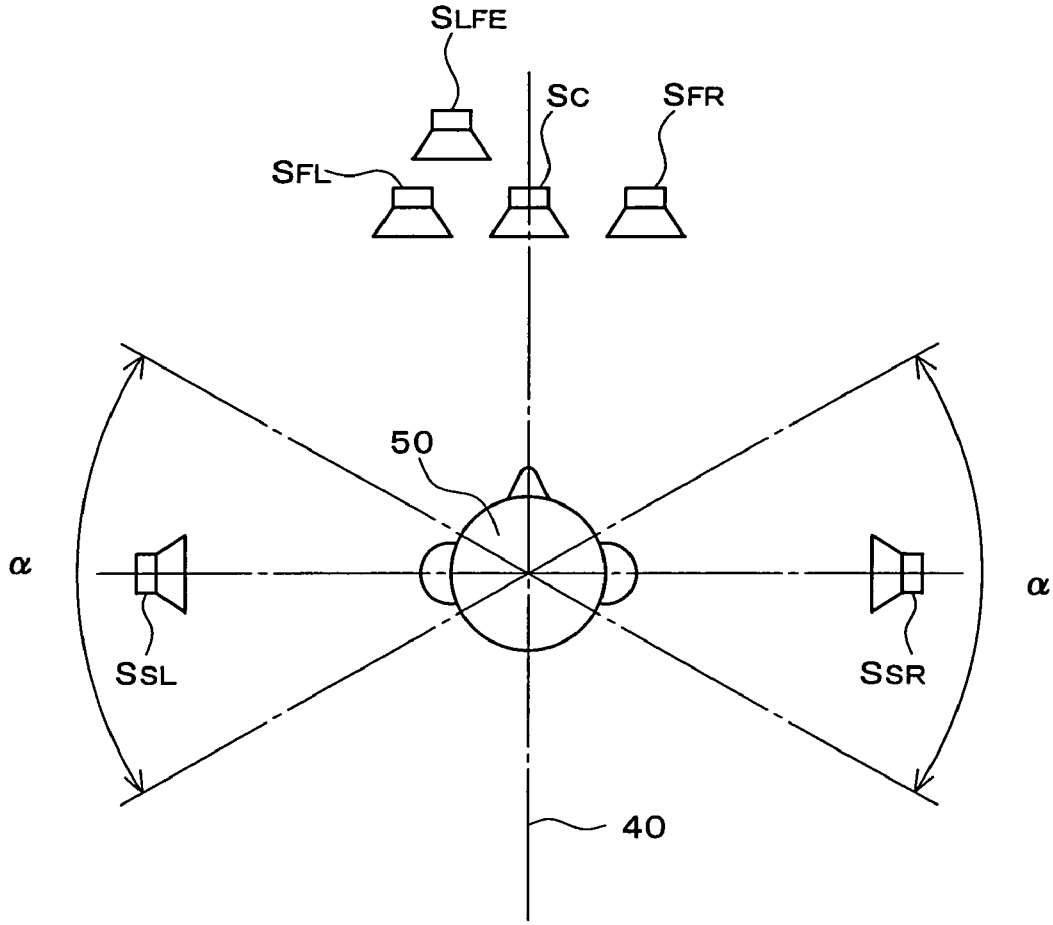
FIG. 5 is a schematic view illustrating an arrangement of speakers in accordance with a surround audio reproduction apparatus of the present invention.

The output signals obtained in the above-mentioned manner are supplied to respective speakers as shown in FIG. 5.

More specifically, the central channel signal C is supplied to a speaker $S_C$; the front left channel signal $F_L$ is supplied to a speaker $S_{FL}$; the front right channel signal $F_R$ is supplied to a speaker $S_{FR}$; and the low frequency channel signal LFE is supplied to a speaker $S_{LFE}$. Furthermore, the surround left channel signal $S'_L$ is supplied to a speaker $S_{SL}$, and the surround right channel signal $S'_R$ is supplied to a speaker $S_{SR}$.

Alternatively, the relative phase difference of 140 to 160 degrees can be obtained by producing a phase difference of 20 to 40 degrees between the channels with APFs and then inversing the phase of one of the channels.

Although the desired phase difference is produced in the frequency region of 200 Hz to 1 kHz according to the above-mentioned embodiment, it is more preferred if the desired phase difference can be obtained in the frequency region of 50 Hz to 4 kHz. The higher order of the APFs widens the frequency band wherein the desired phase difference is obtained.

Although the above-mentioned embodiment has illustrated the case where the surround speakers $S_{SL}$ and $S_{SR}$ are arranged at just the left and the right sides to the listener 50, the surround speakers $S_{SL}$ and $S_{SR}$ may be arranged in an angular range represented by $\alpha$ of FIG. 5. In FIG. 5, the angle range $\alpha$ of 60 degrees (more specifically, 30 degrees both in front and in rear with respect to the line connecting the surround speakers $S_{SL}$ and $S_{SR}$) is exemplified. Accordingly, in the present specification, the phrase "substantially at left and right sides to a listener" is meant to be the above-mentioned angular range $\alpha$.

Figure 6:
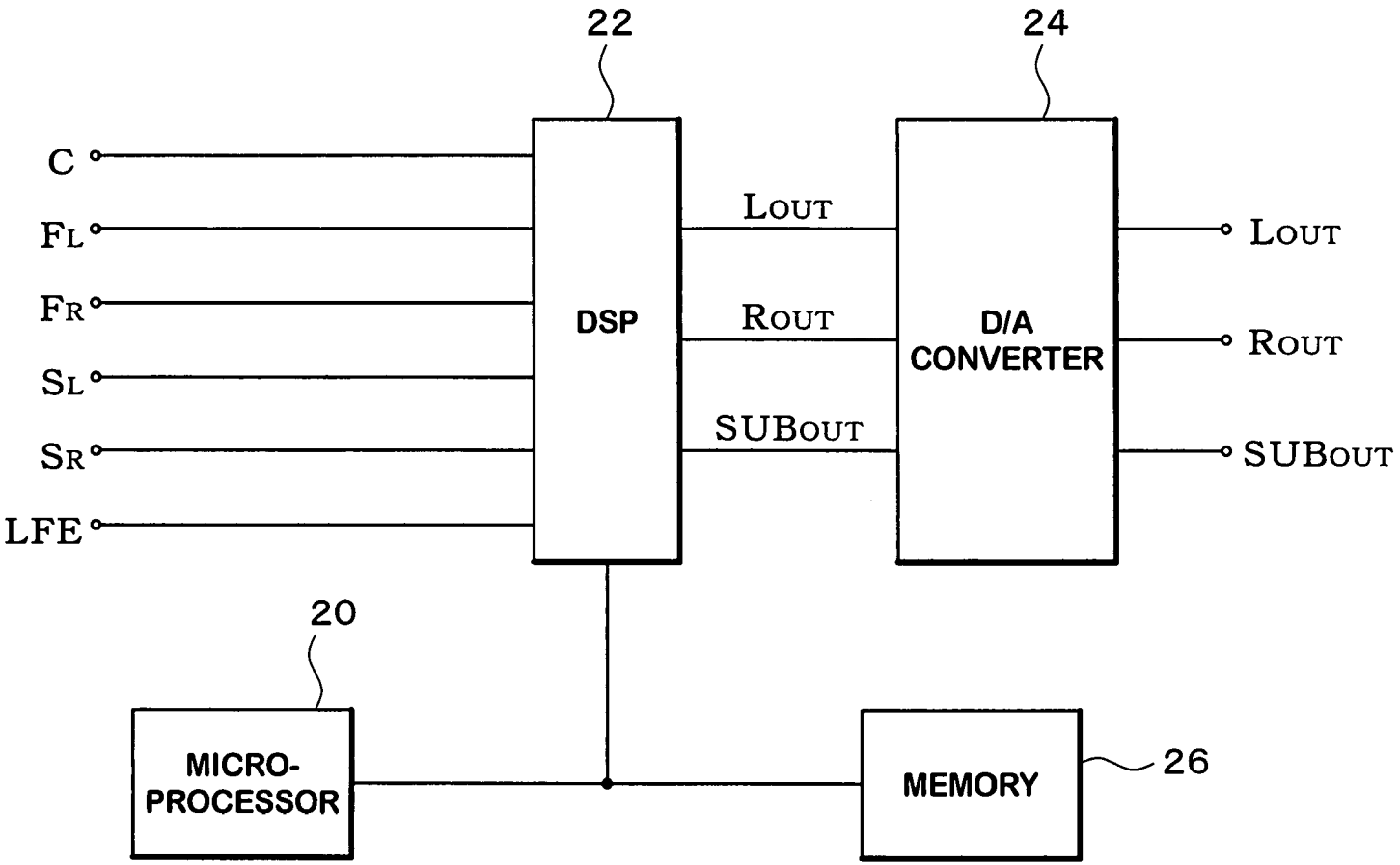
FIG. 6 is a block diagram according to an embodiment wherein the audio signal processing circuit of the present invention is applied to a surround audio reproduction apparatus which produces virtual sound sources by a sound image localization processing using DSP.

FIG. 6 shows a surround audio reproduction apparatus creating virtual sound sources with DSP, wherein the phase difference control portion in accordance with the present invention is incorporated. The respective input signals C, $F_L$, $F_R$, $S_L$, $S_R$ and LFE are obtained by decoding a digitized data converted from an analog signal with an A/D converter or a digital-bit-stream encoded for surround, with a multi-channel surround decoder (not shown). The respective input signals are supplied to the DSP 22. The multi-channel surround decoder can either be incorporated into the DSP or separately provided therefrom.

A signal for a left speaker $L_{OUT}$, a signal for a right speaker $R_{OUT}$ and a signal for a sub-woofer speaker $SUB_{OUT}$ are produced by performing processings such as addition, subtraction, filtering, delay and the like with the DSP 22 to the thus-input digital data in accordance with program(s) stored in a memory 26. The thus-produced signals are converted into analog signals with a D/A converter 24 and are supplied to the speakers $S_{FL}$, $S_{FR}$ and $S_{LFE}$. Installation process of the program(s) into the memory 26 and other processings are carried out by a micro-processor 20.

Figure 7:
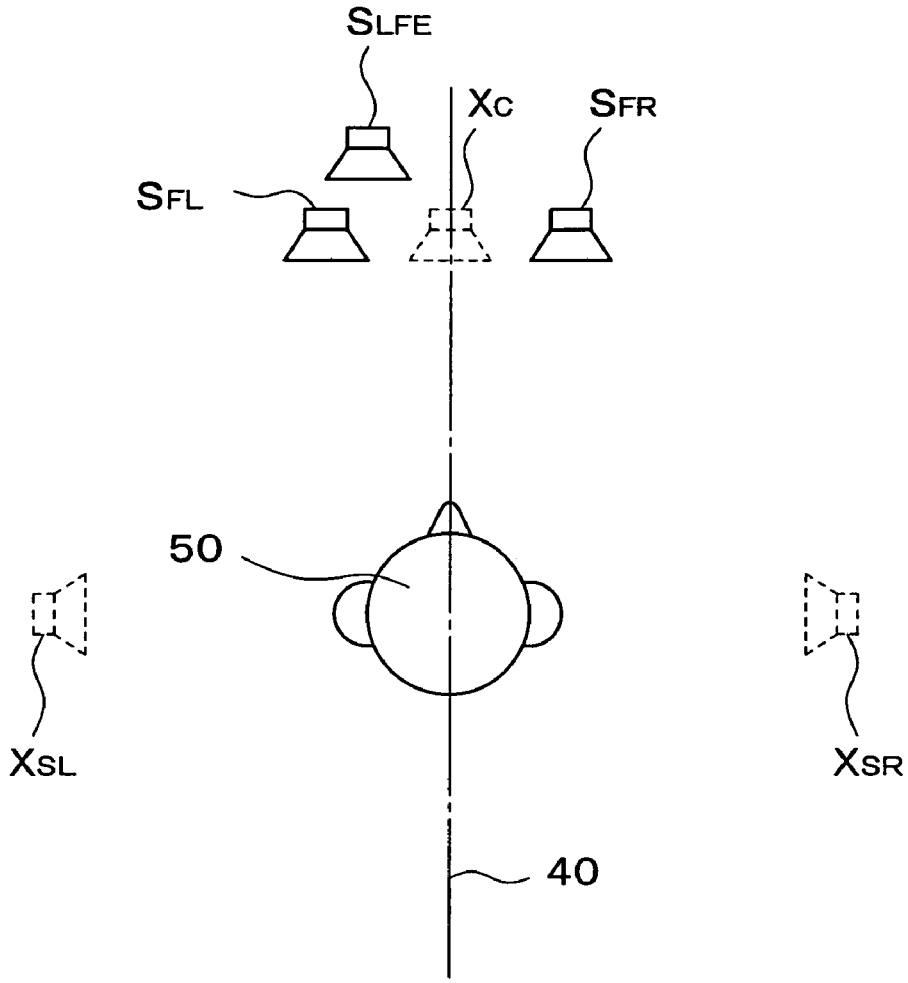
FIG. 7 is a schematic view illustrating an example of an arrangement of the virtual sound sources of FIG. 6.

In this embodiment, it is presumed that the speakers $S_{FL}$ and $S_{FR}$ and the virtual surround sound sources $X_{SL}$ and $X_{SR}$ are symmetrically arranged with respect to the central axis 40 through the listener as shown in FIG. 7. Since bass (sound having a low frequency) reproduced by the woofer speaker $S_{LFE}$ has a weak directivity and a long wavelength, the woofer speaker $S_{LFE}$ can be arranged at any location.

Figure 8:
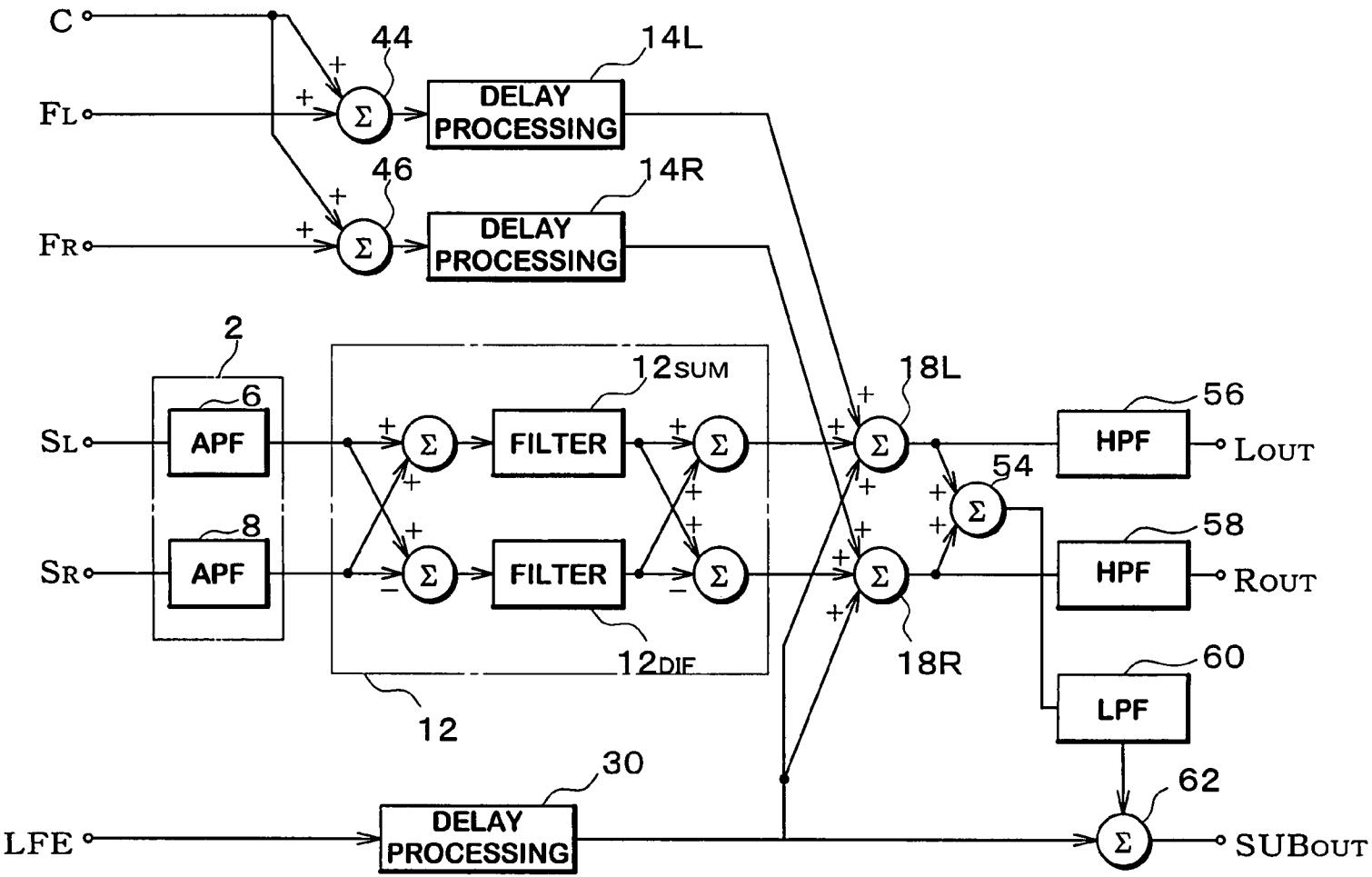
FIG. 8 is a signal-flow diagram illustrating the sound image localization processing using DSP.

FIG. 8 is a signal-flow diagram illustrating processings carried out by the DSP 22 in accordance with the program(s) stored in the memory 26. According to this embodiment, as shown in FIG. 7, the virtual central sound source $X_C$, the virtual surround left sound source $X_{SL}$ and the virtual surround right sound source $X_{SR}$ are created by using only the front left and right speakers $S_{FL}$ and $S_{FR}$ and the low frequency speaker $S_{LFE}$.

The surround left channel signal $S_L$ and the surround right channel signal $S_R$ are subjected to a sound image localization processing with a surround sound image localization circuit 12 and are supplied to the left and the right speakers $S_{FL}$ and $S_{FR}$ arranged in front of the listener. The surround sound image localization circuit 12 is composed of a so-called shuffler type filter. Therefore, the effect that the surround left channel signal $S_L$ and the surround right channel signal $S_R$ are output respectively from the virtual surround left sound source $X_{SL}$ and the virtual surround right sound source $X_{SR}$ can be obtained.

The central channel signal C is equally supplied to the left and the right speakers $S_{FL}$ and $S_{FR}$. Therefore, the effect that the central channel signal C is output from the virtual central sound source $X_C$ can be obtained.

Delay processing circuits 14L, 14R and 30 provide a delay time equal to that caused by the surround sound image localization circuit 12. These delay circuits can compensate the delay between the signals C, $F_L$, $F_R$ and LFE and the signals $S_L$ and $S_R$.

The surround left channel signal $S_L$ and the surround right channel signal $S_R$ are subjected to a phase difference control processing with the phase difference control portion 2 in the above-mentioned manner before being supplied to the surround sound image localization circuit 12. Therefore, a relative phase difference of 140 to 160 degrees has already been produced between the surround left channel signal $S_L$ and the surround right channel signal $S_R$.

Figure 9:
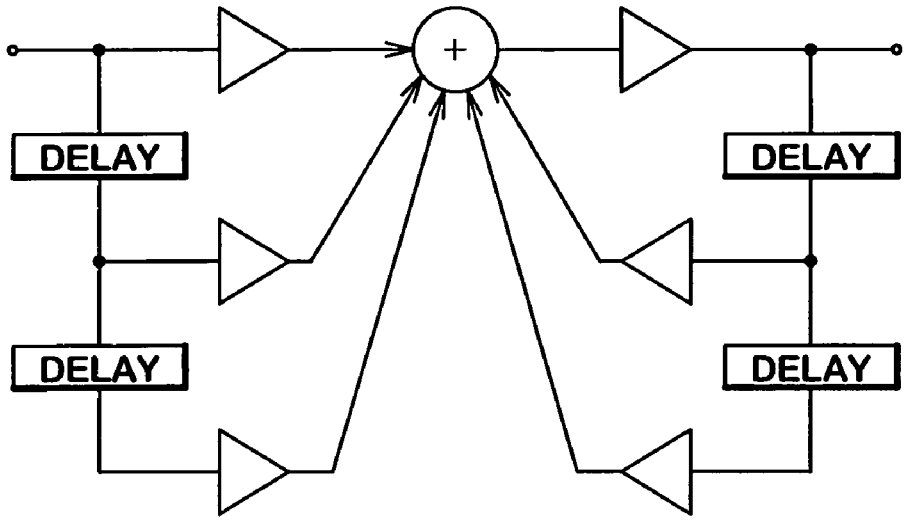
FIG. 9 is a signal-flow diagram illustrating an embodiment wherein an all pass filter used in the present invention is composed of a secondary IIR filter.

In this embodiment, a secondary IIR filter as shown in FIG. 9 is used as the APFs 6 and 8 constituting the phase difference control portion 2.

Since the phase difference control processing is performed with the phase difference control portion 2, the surround left channel signal $S_L$ output from the virtual surround left sound source $X_{SL}$ and the surround right channel signal $S_R$ output from the virtual surround right sound source $X_{SR}$ may be prevented from being localized in the head of the listener 50.

Figure 10:
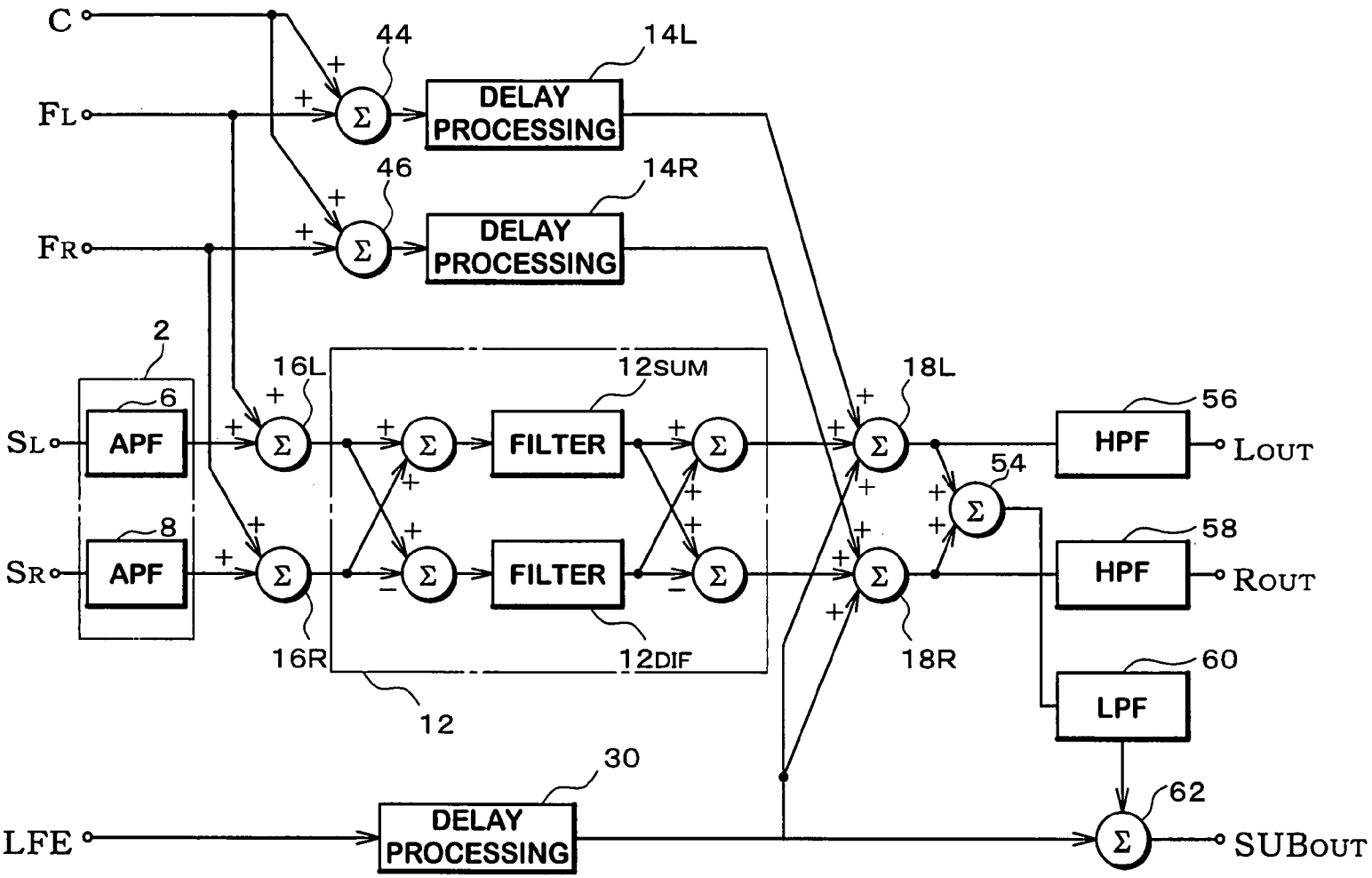
FIG. 10 is a signal-flow diagram according to another embodiment of the present invention.
Figure 11:
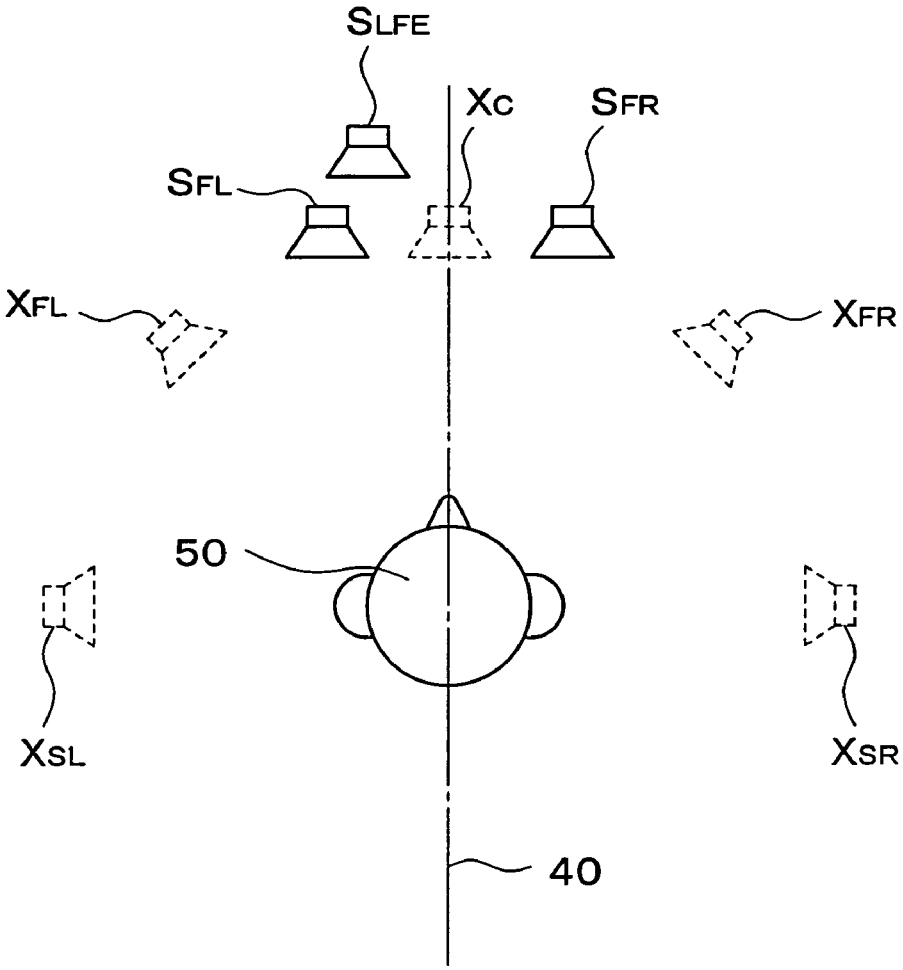
FIG. 11 is a schematic view illustrating an example of an arrangement of the virtual sound sources of FIG. 10.

FIG. 10 is a signal-flow diagram according to another embodiment of the present invention. According to this embodiment, the front left channel signal $F_L$ and the front right channel signal $F_R$ are respectively added to the surround left channel signal $S_L$ and the surround right channel signal $S_R$ which have already been subjected to the phase difference control processing. As a result, as shown in FIG. 11, the front left channel signal $F_L$ is localized at the position of the virtual sound source $X_{FL}$ located between the positions of the left speaker $S_{FL}$ and the virtual surround left sound source $X_{SL}$. Likewise, the front right channel signal $F_R$ is localized at the position of the virtual sound source $X_{FR}$ located between the positions of the right speaker $S_{FR}$ and the virtual surround right sound source $X_{SR}$. Accordingly, sound field created by the front left channel signal $F_L$ and the front right channel signal $F_R$ can be widen.

In the above embodiments, an analog circuit can be used in place of the described digital circuit and a digital circuit can be used in place of the described analog circuit.

Figure 12:
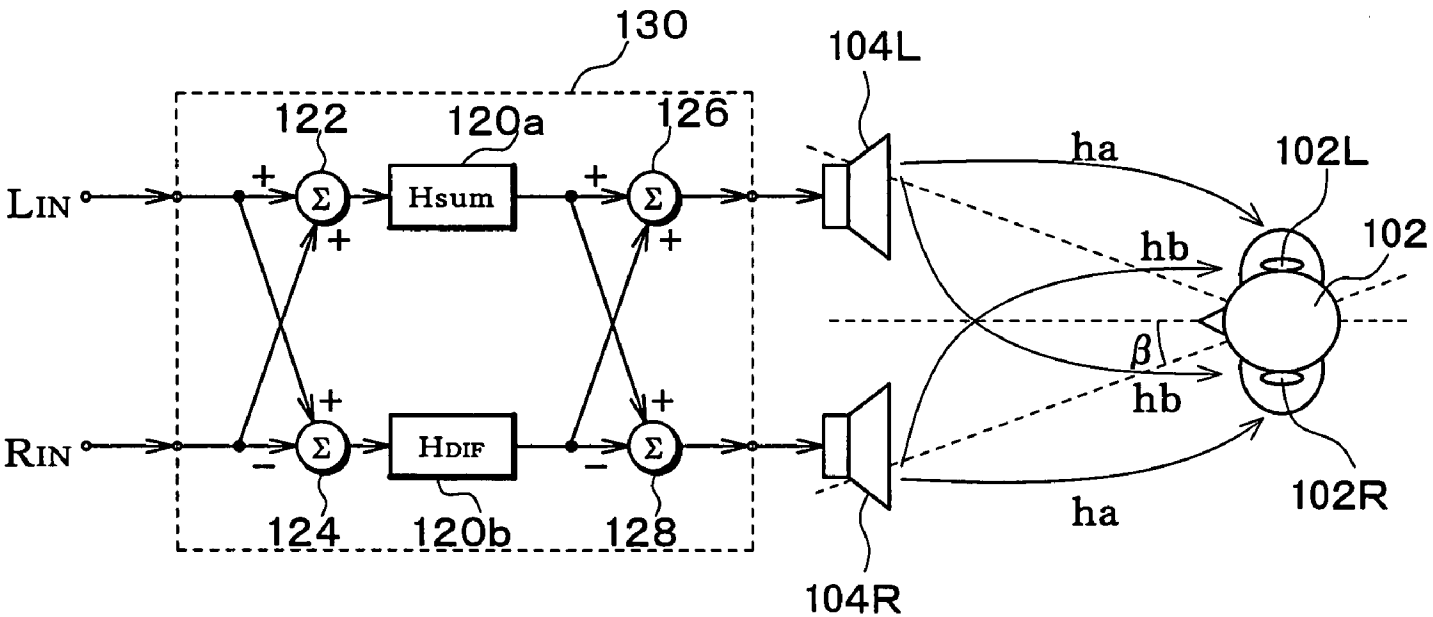
FIG. 12 is a schematic view of a shuffler type filter according to an embodiment of the present invention.

FIG. 12 is a schematic view of a shuffler type cross-talk cancel filter 130 according to an embodiment of the present invention. A left channel signal is supplied to a left channel input terminal $L_{IN}$ and a right channel signal is supplied to a right channel input terminal $R_{IN}$. The left and the right channel signals are added up with an adder 122 and the added signal is supplied to a first filter 120*a*. The right channel signal is subtracted from the left channel signal with a subtracter 124 and the subtracted signal is supplied to a second filter 120*b*. Transfer functions $H_{SUM}$ and $H_{DIF}$ of the first and the second filters 120*a* and 120*b* are represented by the following equations, respectively:

$$H_{SUM}=ha/2(ha+hb)$$

$$H_{DIF}=ha/2(ha-hb)$$

An adder 126 adds the outputs of the first and the second filters 120*a* and 120*b* and outputs a signal for a speaker 104L. A subtracter 128 subtracts the outputs of the second filter 120*b* from the output of the first filter 120*a* and outputs a signal for a speaker 104R.

Figure 13:
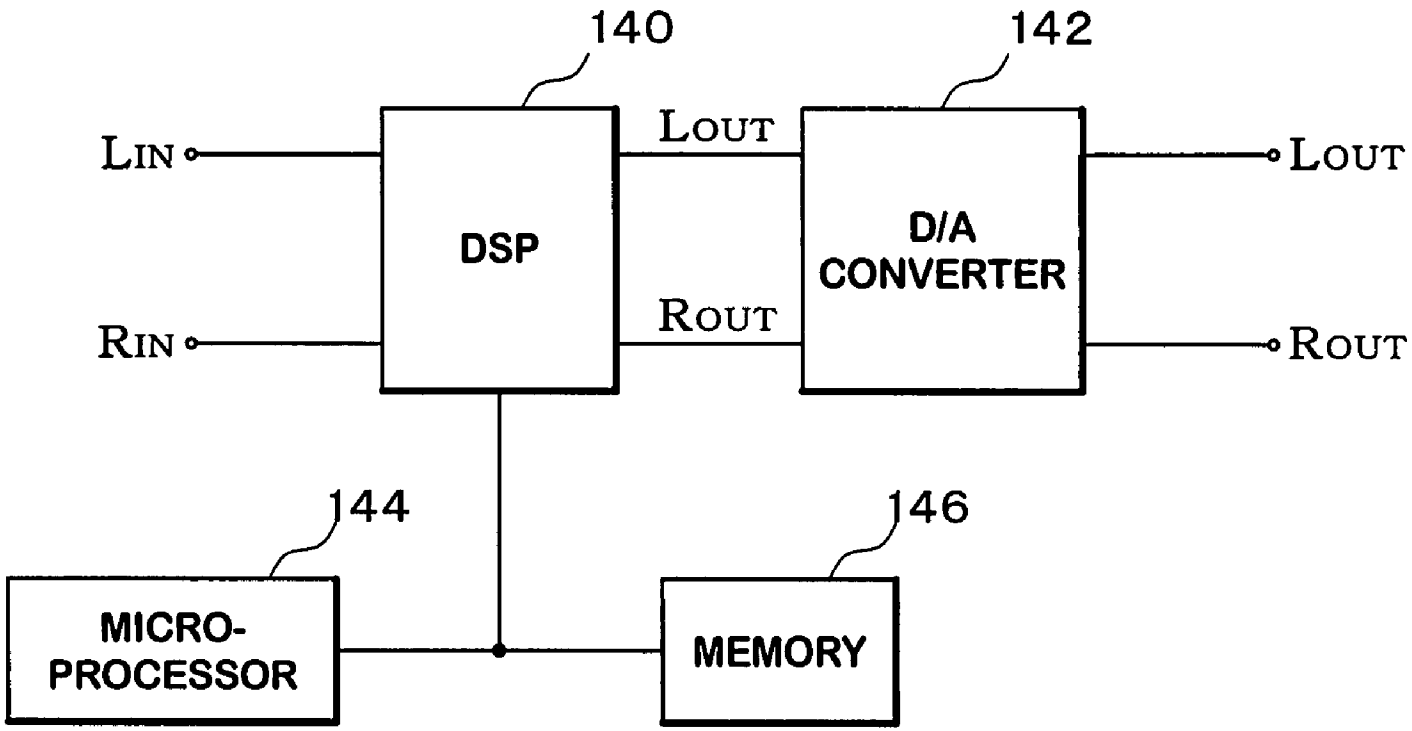
FIG. 13 is a block diagram illustrating a hardware structure of the audio reproduction apparatus using DSP.

According to this embodiment, the first and the second filters 120*a* and 120*b* are FIR filters and the cross-talk cancel filter 130 is composed of DSP. FIG. 13 is a block diagram illustrating a hardware structure of the audio reproduction apparatus using DSP 140. A left and a right channel signals L and R are supplied as digital data to the DSP 140. A signal for a left speaker $L_{OUT}$ and a signal for a right speaker $R_{OUT}$ are produced by performing processings such as addition, subtraction, filtering, delay and the like with the DSP 140 to the thus-input digital data in accordance with program(s) stored in a memory 146. The thus-produced signals are converted into analog signals with a D/A converter 142 and are supplied to the speakers 104L and 104R. Installation process of the program(s) into the memory 26 and other processings are carried out by a micro-processor 120.

Figure 14:
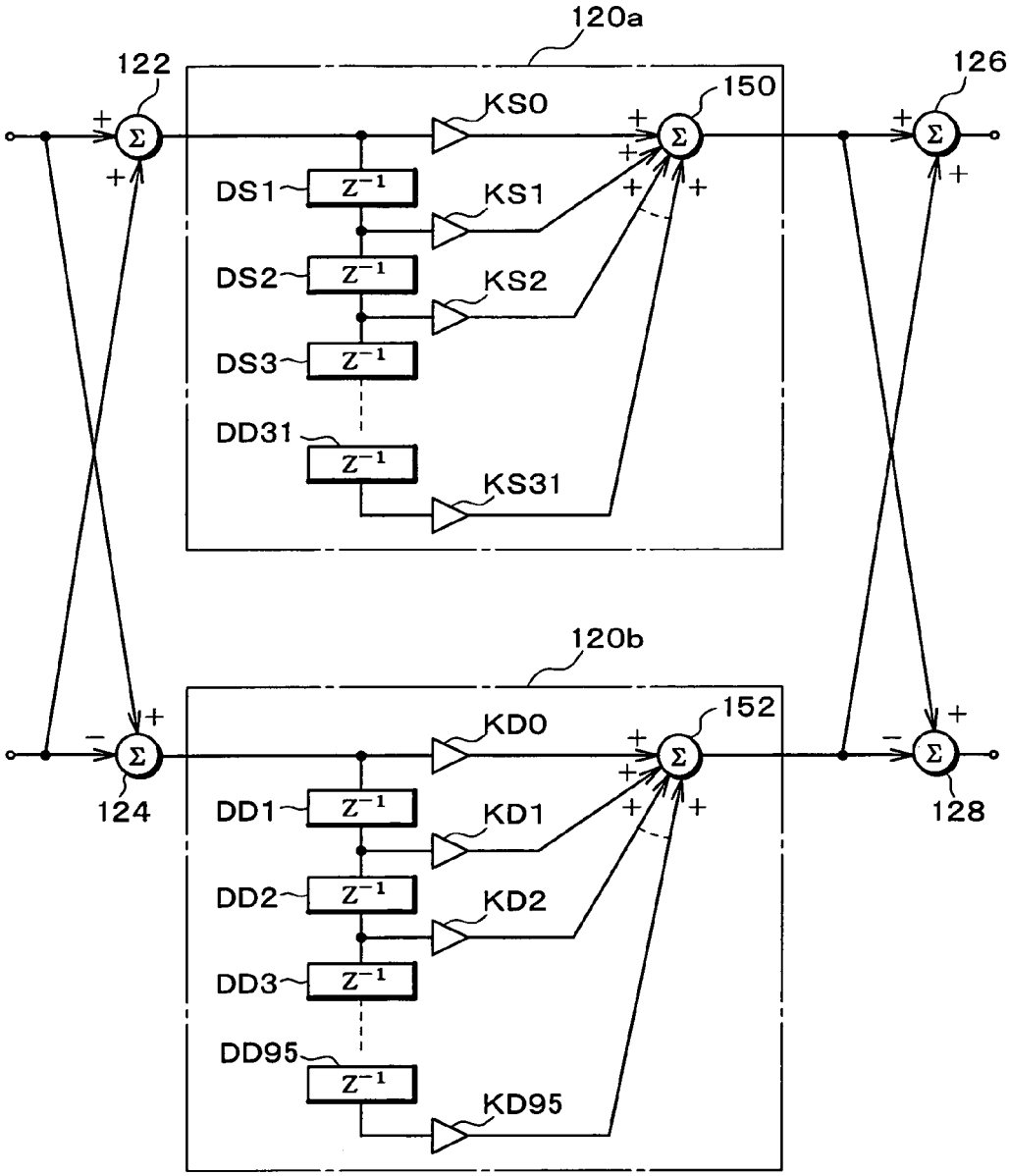
FIG. 14 is a signal-flow diagram illustrating processings carried out by the DSP in accordance with program(s) stored in a memory.

FIG. 14 is a signal-flow diagram illustrating processings carried out by the DSP 140 in accordance with the program(s) stored in the memory 146. According to this embodiment, the first and the second filters 120*a* and 120*b* are FIR filters. In FIG. 14, DS1 to DS31 and DD1 to DD95 denote delay means. The delay means perform delay processing in an amount of one sampling data. In this embodiment, the sample frequency is set to be 48 kHz. KS0 to KS31 and KD0 to KD95 denote coefficient processing means. In this embodiment, the tap number (i.e., the number of the coefficient processings) of the first filter 120*a* is set to be 32 and the tap number of the second filter 120*b* is set to be 96. In the case of FIR filter, the larger tap number produces the higher accuracy in a low frequency region. Accordingly, in the example of FIG. 14, the accuracy of the second filter 120*b* is higher than that of the first filter 120*a* in a low frequency region.

Figure 15:
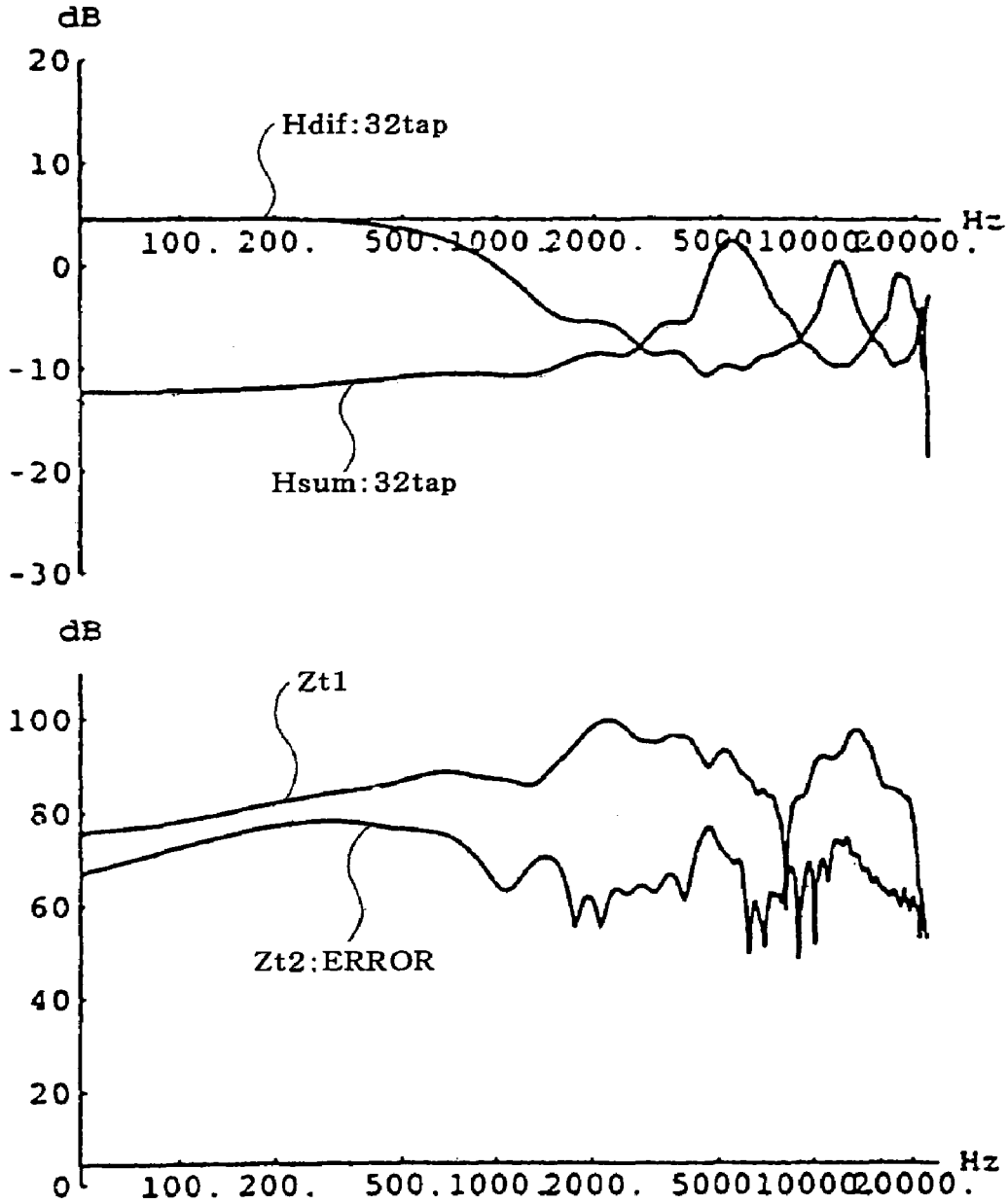
FIG. 15 is a graph illustrating a frequency response $H_{SUM}$ of a first filter and a frequency response $H_{DIF}$ of a second filter, and a cross-talk cancel response Zt1 and a cross-talk cancel error Zt2 when the first and the second filters are used, wherein both of the first and the second filters have 32 taps.

FIG. 15 shows a frequency response $H_{SUM}$ of the first filter 120*a* and a frequency response $H_{DIF}$ of the second filter 120*b* wherein the first and the second filters have 32 taps. FIG. 15 also shows a cross-talk cancel response Zt1 and a cross-talk cancel error Zt2 when a cross-talk cancel filter wherein the first and the second filters are incorporated is used. Here, the error is meant to be a remained response (i.e., a response that had not been sufficiently canceled). Therefore, regarding the cross-talk cancel filter, the better filter produces the smaller error. In this embodiment, an angle β defined by the speaker 104L (or 104R) and the listener 102 as shown in FIG. 12 is set to be 10 degrees. As shown in FIG. 15, when the tap number of the first and the second filters 120*a* and 120*b* is 32, the accuracy is low and a large cross-talk cancel error is caused.

Figure 16:
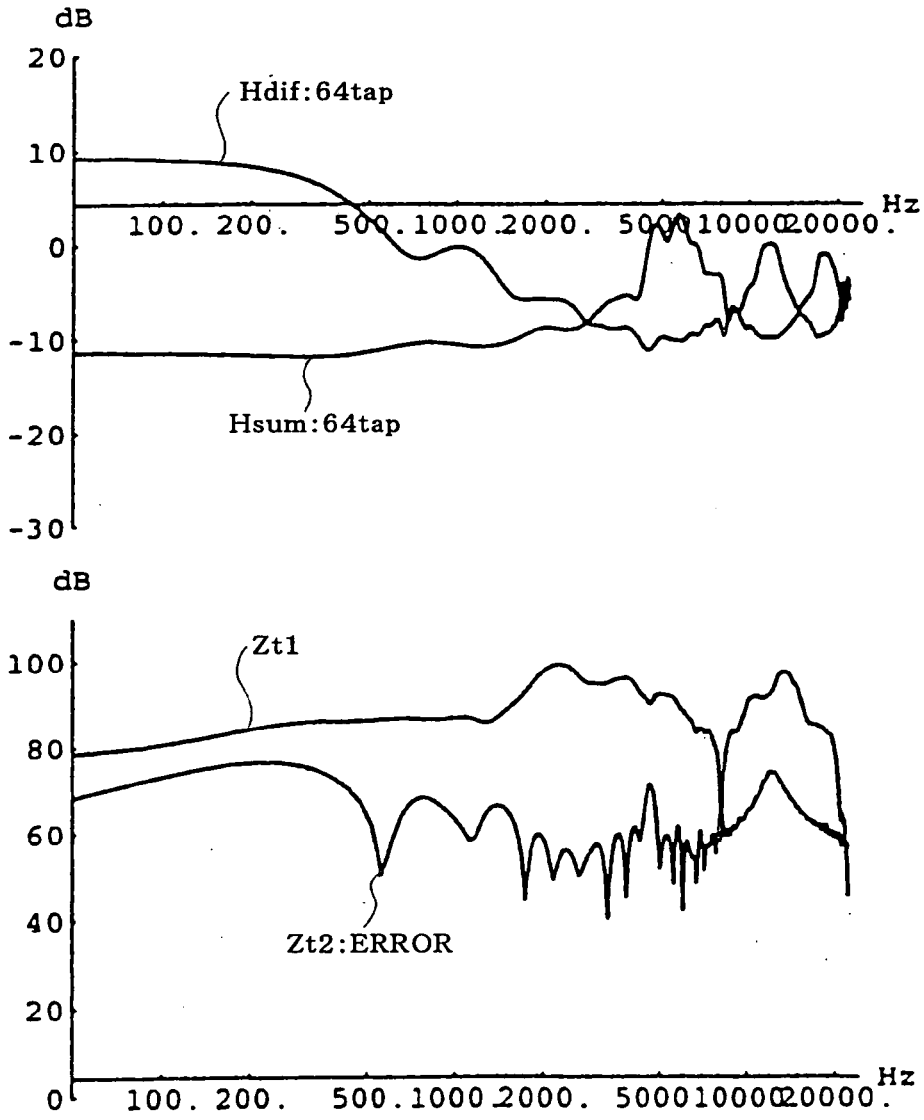
FIG. 16 is a graph illustrating $H_{SUM}$, $H_{DIF}$, Zt1 and Zt2 wherein both of the first and the second filters have 64 taps.

FIG. 16 shows a frequency response $H_{SUM}$ of the first filter 120*a* and a frequency response $H_{DIF}$ of the second filter 120*b* wherein the first and the second filters have 64 taps. FIG. 16 also shows a cross-talk cancel response Zt1 and a cross-talk cancel error Zt2 when a cross-talk cancel filter wherein the first and the second filters are incorporated is used. FIG. 16 shows that, although the cross-talk cancel properties are improved compared to the case of 32 taps shown in FIG. 15, the cross-talk cancel error is still large.

Figure 17:
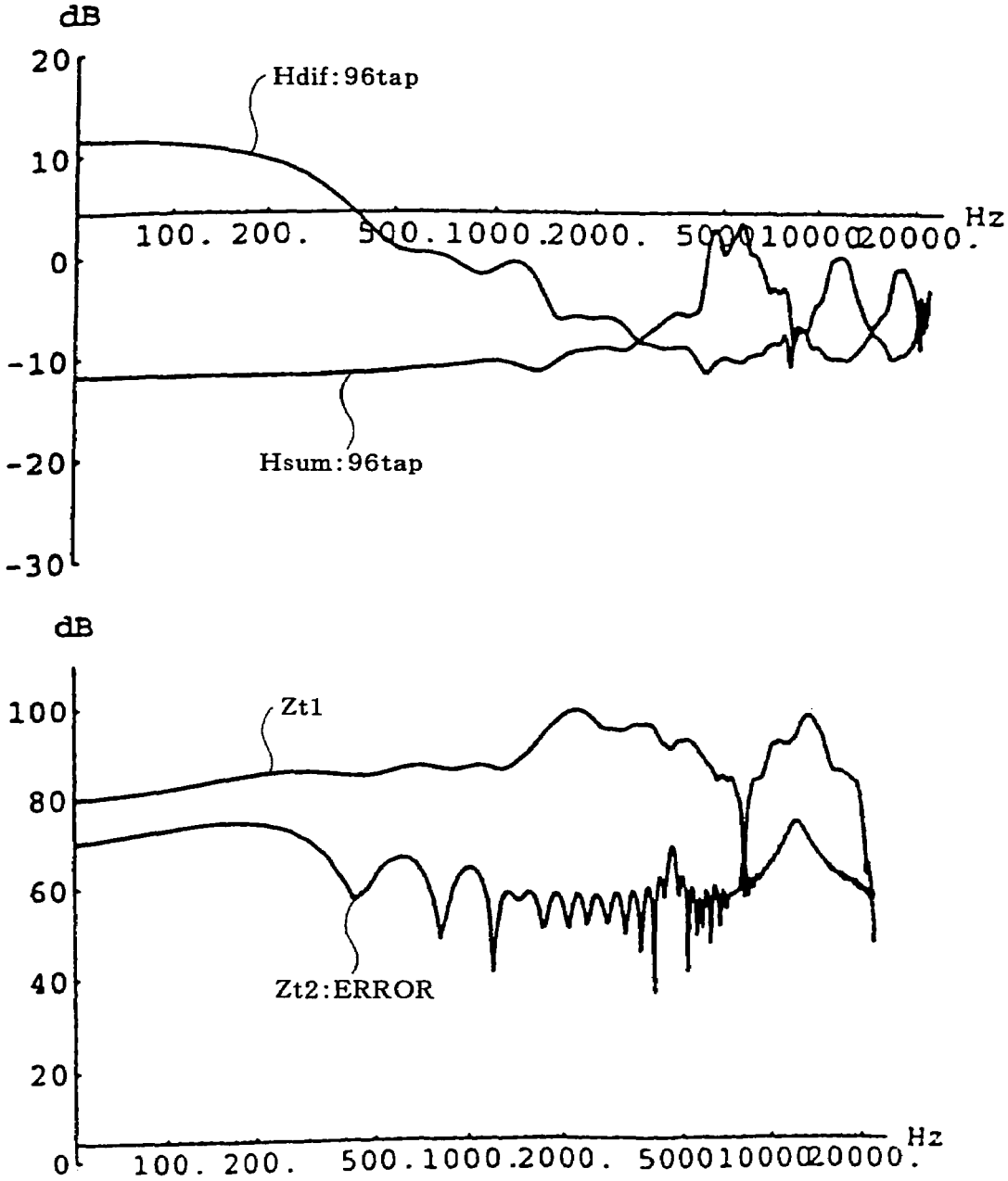
FIG. 17 is a graph illustrating $H_{SUM}$, $H_{DIF}$, Zt1 and Zt2 wherein both of the first and the second filters have 96 taps.

FIG. 17 shows a case where the first and the second filters 120*a* and 120*b* have 96 taps. FIG. 17 shows that the cross-talk cancel error is small. However, in this case, the problem that an arithmetical load to DSP 140 is large arises.

According to this embodiment, the tap number of the first filter 120*a* is set to be smaller than that of the second filter 120*b* in view of the fact that a frequency response required for the first filter 120*a* is low level and flat especially in a low frequency region. In other words, the accuracy of the first filter 120*a* is set to be low in a low frequency region and the accuracy of the second filter 120*b* is set to be higher instead. More specifically, the tap number of the first filter 120*a* is set to be 32 and the tap number of the second filter 120*b* is set to be 96. Frequency response $H_{SUM}$ and $H_{DIF}$, a cross-talk cancel response zt1 and a cross-talk cancel error zt2 in this case are shown in FIG. 18.

Figure 18:
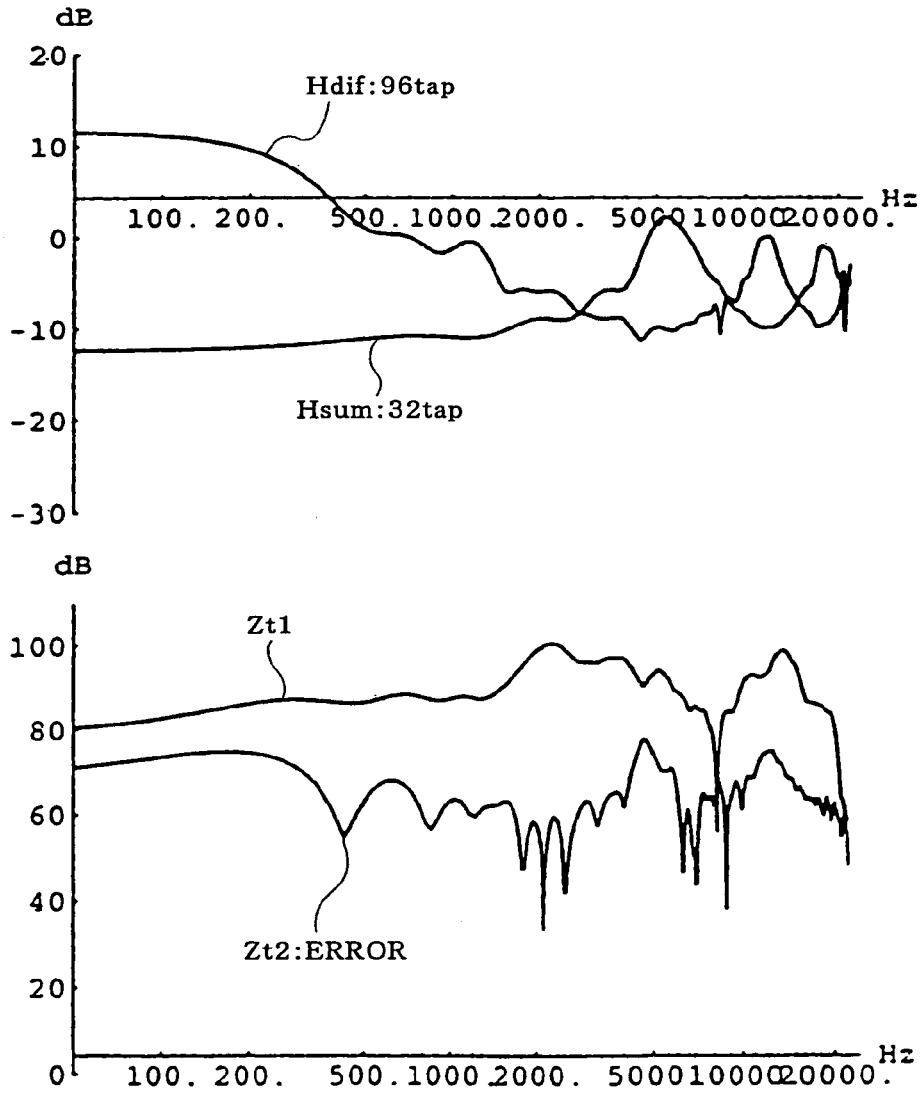
FIG. 18 is a graph illustrating $H_{SUM}$, $H_{DIF}$, Zt1 and Zt2 wherein the first filter has 32 taps and the second filter has 96 taps.

As is apparent from FIG. 18, the error in this case is as small as that in the case where the tap numbers of the first and the second filters 120*a* and 120*b* are both 96. According to this embodiment, a shuffler type cross-talk cancel filter having high accuracy can be obtained while keeping low a total tap number thereof.

Figure 19:
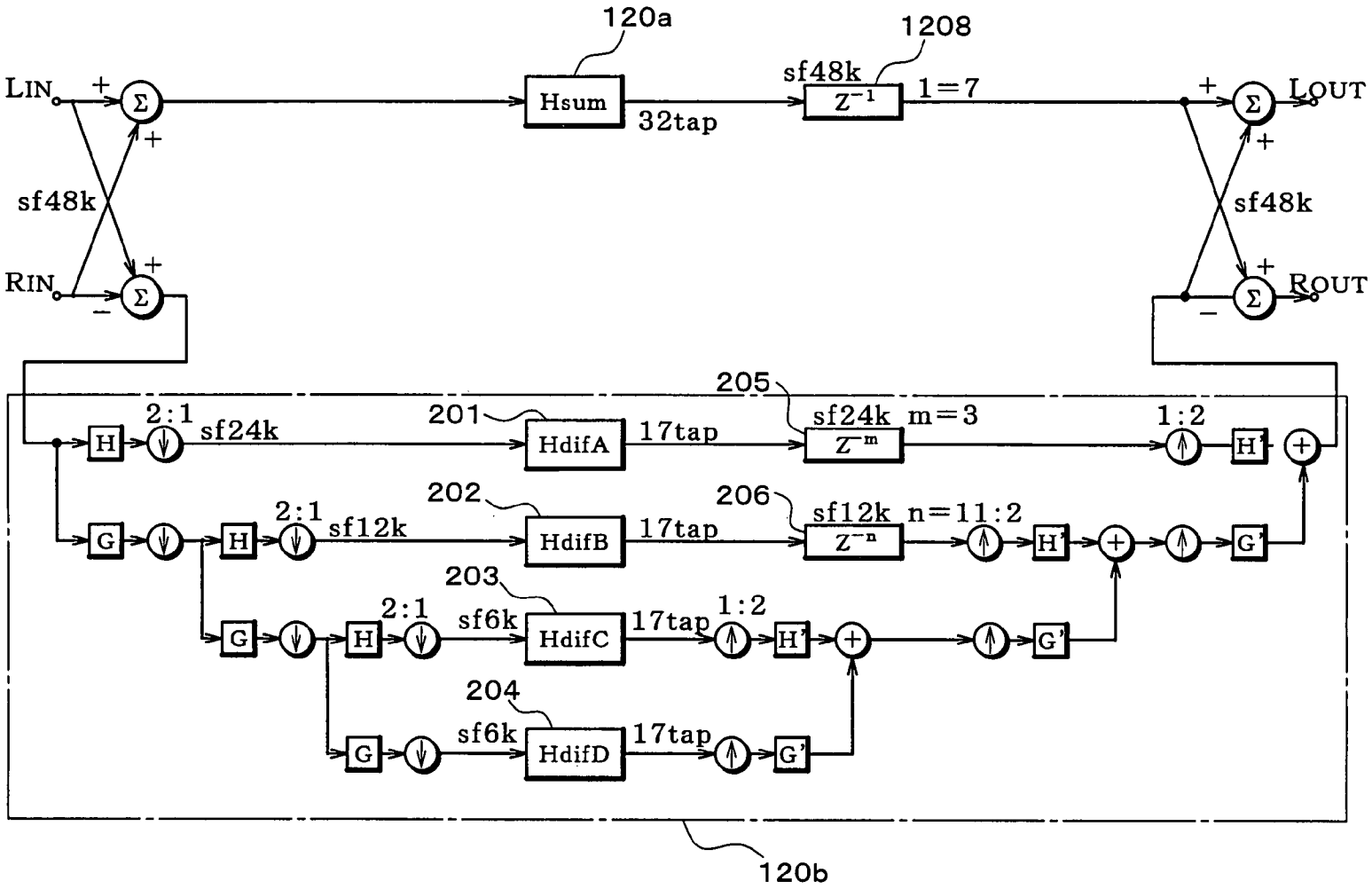
FIG. 19 is a signal-flow diagram according to an embodiment using a filter bank.

FIG. 19 is a signal-flow diagram according to another embodiment of the present invention. FIR filters are also employed in this embodiment. Furthermore, the tap number of the second filter 120*b* is set to be larger than that of the first filter 120*a*. More specifically, the tap number of the second filter 120*b* is set to correspond to 128 and the tap number of the first filter 120*a* is set to be 32. In addition, a filter bank is employed for the second filter 120*b* according to this embodiment. As a result, down-sampling is performed with respect to the signal supplied to the second filter 120*b* and then the signal is processed with the FIR filters. In FIG. 19, H denotes a high-pass filter, G denotes a low-pass filter, the arrow ↓ denotes down-sampling by 2 and the arrow ↑ denotes up-sampling by 2. Delay means 205, 206 and 208 perform delay processing which compensates a time required for the processing performed by the filter bank. The delay means 205 performs delay processing in an amount of three sampling data, the delay means 206 performs delay processing in an amount of one sampling data, and the delay means 208 performs delay processing in an amount of seven sampling data.

According to this embodiment employing the filter bank, a cross-talk cancel filter having a high ability of 128 taps can be obtained while the total tap number of the FIR filters 201, 202, 203 and 204 is kept 68 taps. In other words, a processing margin can be increased by performing down-sampling. As a result, the accuracy in a low frequency component can be improved. Although a so-called octave dividing filter bank has been exemplified in this embodiment, a so-called equal dividing filter bank may also be employed. According to the octave dividing filter bank, a frequency component is divided in a geometrical ratio preferentially in a lower frequency side. In contrast, according to the equal dividing filter bank, a frequency component is equally divided with respect to an overall frequency region.

Figure 20:
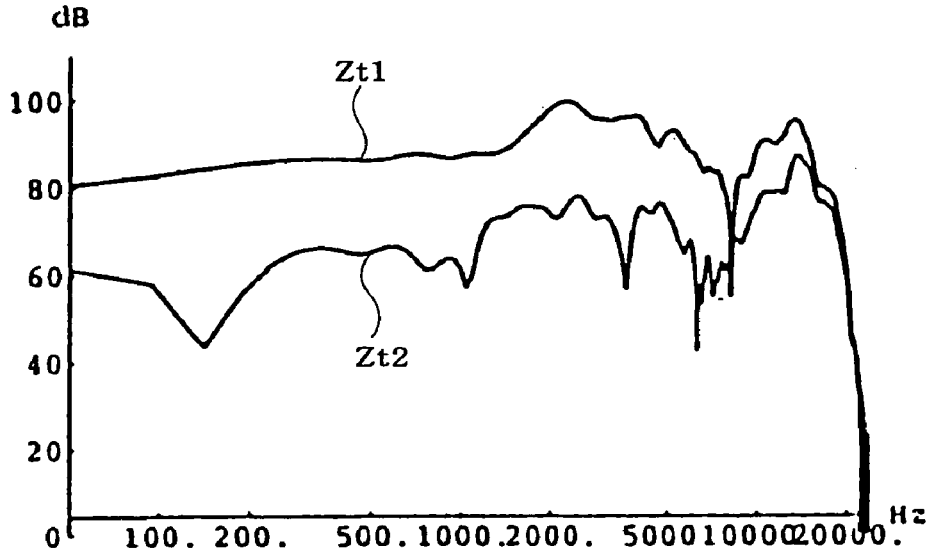
FIG. 20 is a graph illustrating a cross-talk cancel response Zt1 and a cross-talk cancel error Zt2 when the cross-talk cancel filter shown in FIG. 14 is used wherein a first filter having 32 taps and a second filter having 128 taps are incorporated.
Figure 21:
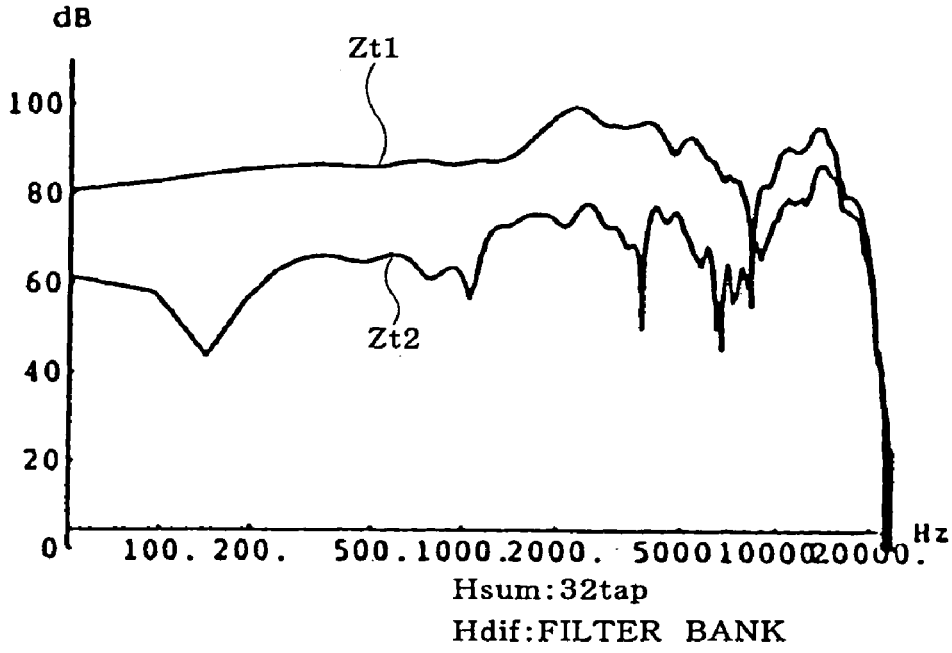
FIG. 21 is a graph illustrating a cross-talk cancel response Zt1 and a cross-talk cancel error Zt2 when the cross-talk cancel filter shown in FIG. 19 is used wherein a first filter having 32 taps and a second filter corresponding to 128 taps are incorporated.

FIG. 20 shows a cross-talk cancel error ZT2 in the case where the tap number of the first filter 120*a* is 32 and the tap number of the second filter 120*b* is 128 and where a filter bank is not employed. FIG. 21 shows a cross-talk cancel error ZT2 when the cross-talk cancel filter shown in FIG. 19 is used. As is apparent from the comparison between FIGS. 20 and 21, the circuit of FIG. 19 which employs a filter bank has the ability as good as that of the circuit having actually 128 taps.

Figure 22:
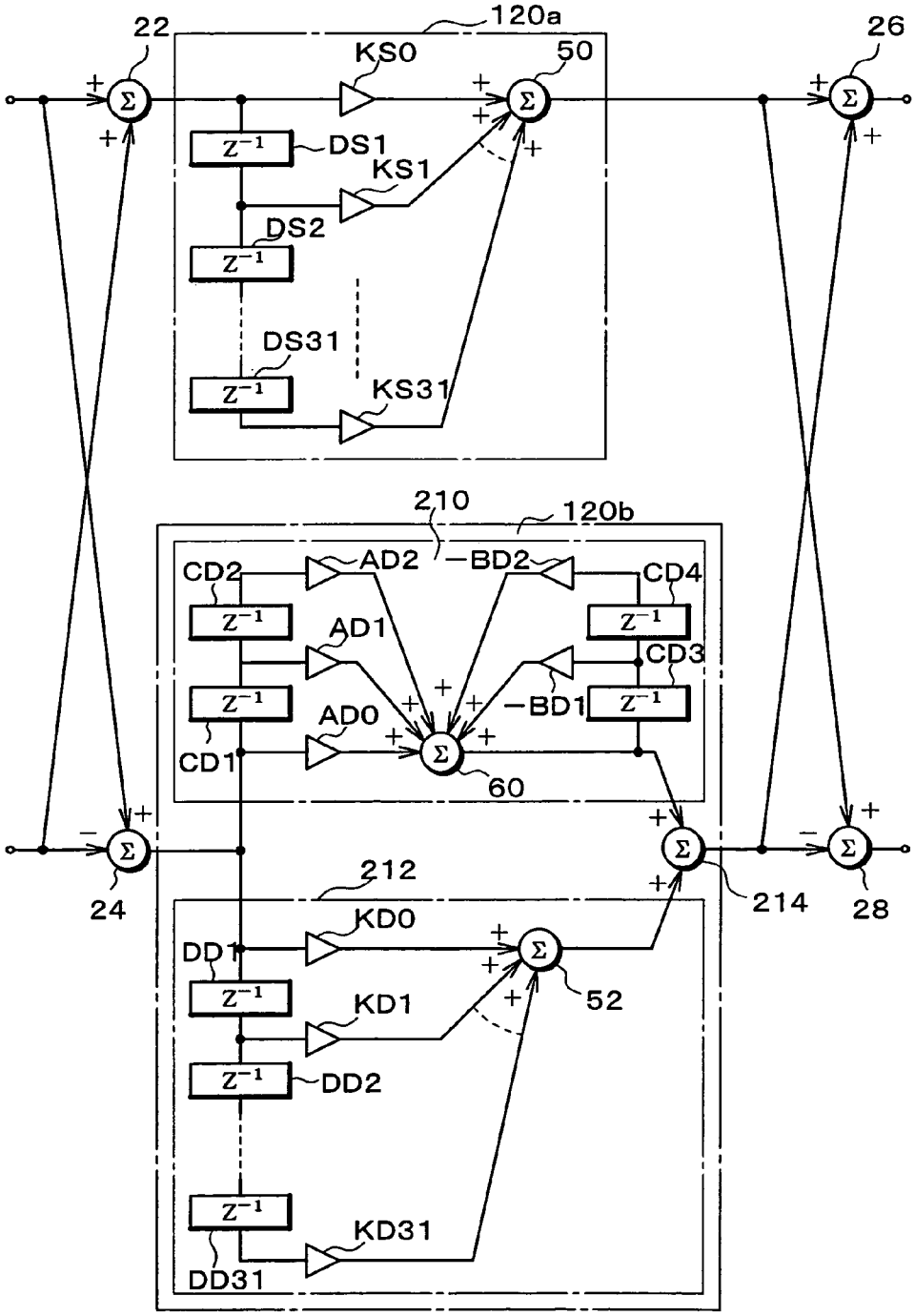
FIG. 22 is a signal-flow diagram according to an embodiment wherein the second filter 120*b* is composed of a parallel connection of FIR filter and IIR filter.

FIG. 22 is a signal-flow diagram according to still another embodiment of the present invention. According to this embodiment, the first filter 120*a* is FIR filter having 32 taps and the second filter 120*b* is composed of a parallel connection of FIR filter 210 having 32 taps and secondary IIR filter 212. The outputs of the FIR filter 210 and the secondary IIR filter 212 are added up with an adder 214.

According to this embodiment, an accuracy with respect to a low frequency component can be improved by utilizing the secondary IIR filter 212 while the tap number of the FIR filter 210 in the second filter is kept 32 taps. Since the secondary IIR filter produces a higher accuracy in a low frequency region, the cross-talk cancel filter according to this embodiment produces an accuracy as high as the filter of FIG. 12 wherein both of the first and the second filters are FIR filters, while the tap number of the filter according to this embodiment is smaller than that of the filter of FIG. 12. Although the secondary IIR filter has been exemplified in this embodiment, IIR filter of the first order or the higher order may also be employed. The IIR filter of the higher order can be composed of either series connection or parallel connection.

Figure 23:
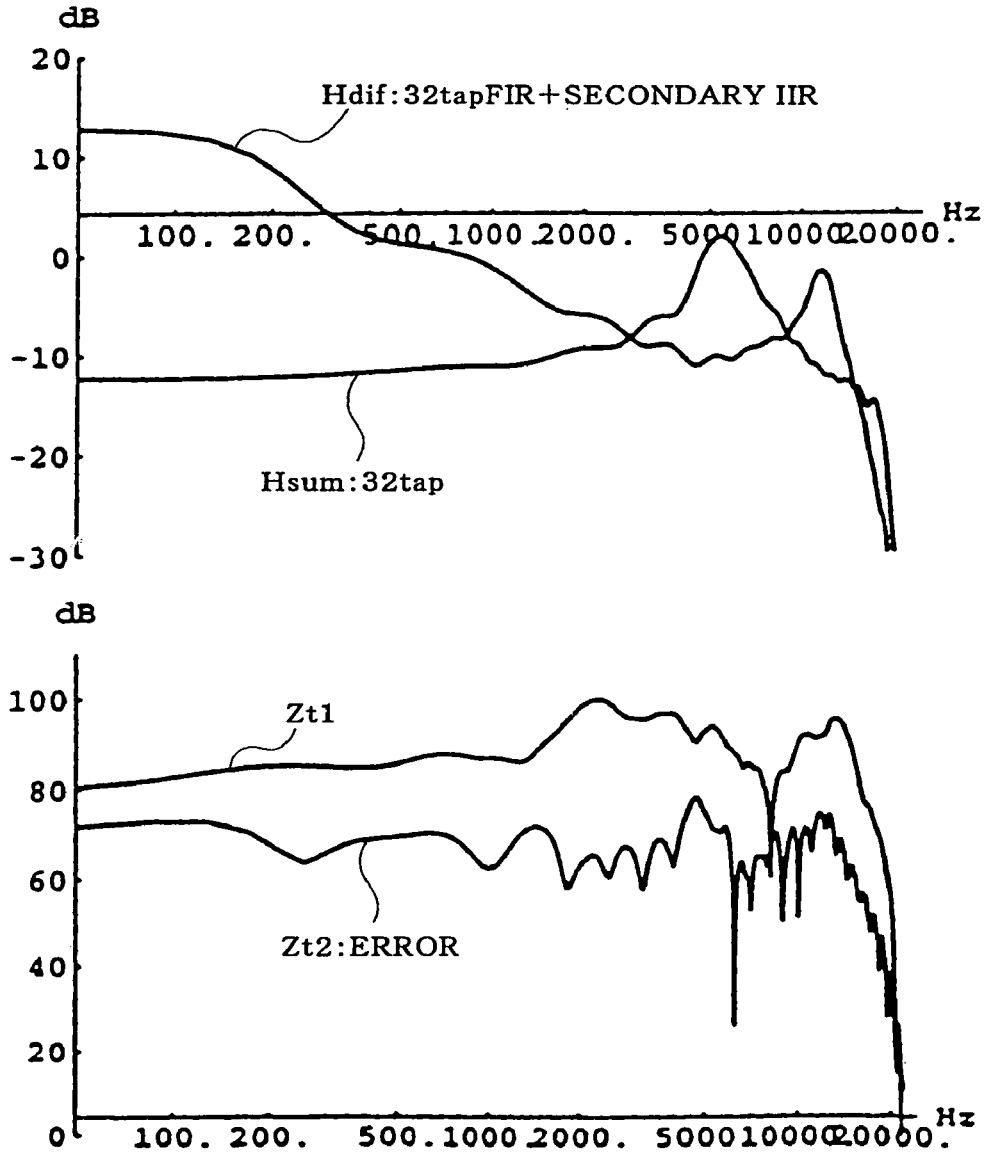
FIG. 23 is a graph illustrating a frequency response $H_{SUM}$ of the first filter and a frequency response $H_{DIF}$ of the second filter, and a cross-talk cancel response Zt1 and a cross-talk cancel error Zt2 when the cross-talk cancel filter shown in FIG. 22 is used.

FIG. 23 shows a frequency response $H_{SUM}$ of the first filter 120*a* and a frequency response $H_{DIF}$ of the second filter 120*b* in the circuit (i.e., the cross-talk cancel filter) of FIG. 22. FIG. 23 also shows a cross-talk cancel response Zt1 and a cross-talk cancel error Zt2 of the circuit of FIG. 22. As is apparent from FIG. 23, accuracy substantially as high as that of the case shown in FIG. 18 is obtained.

Figure 24:
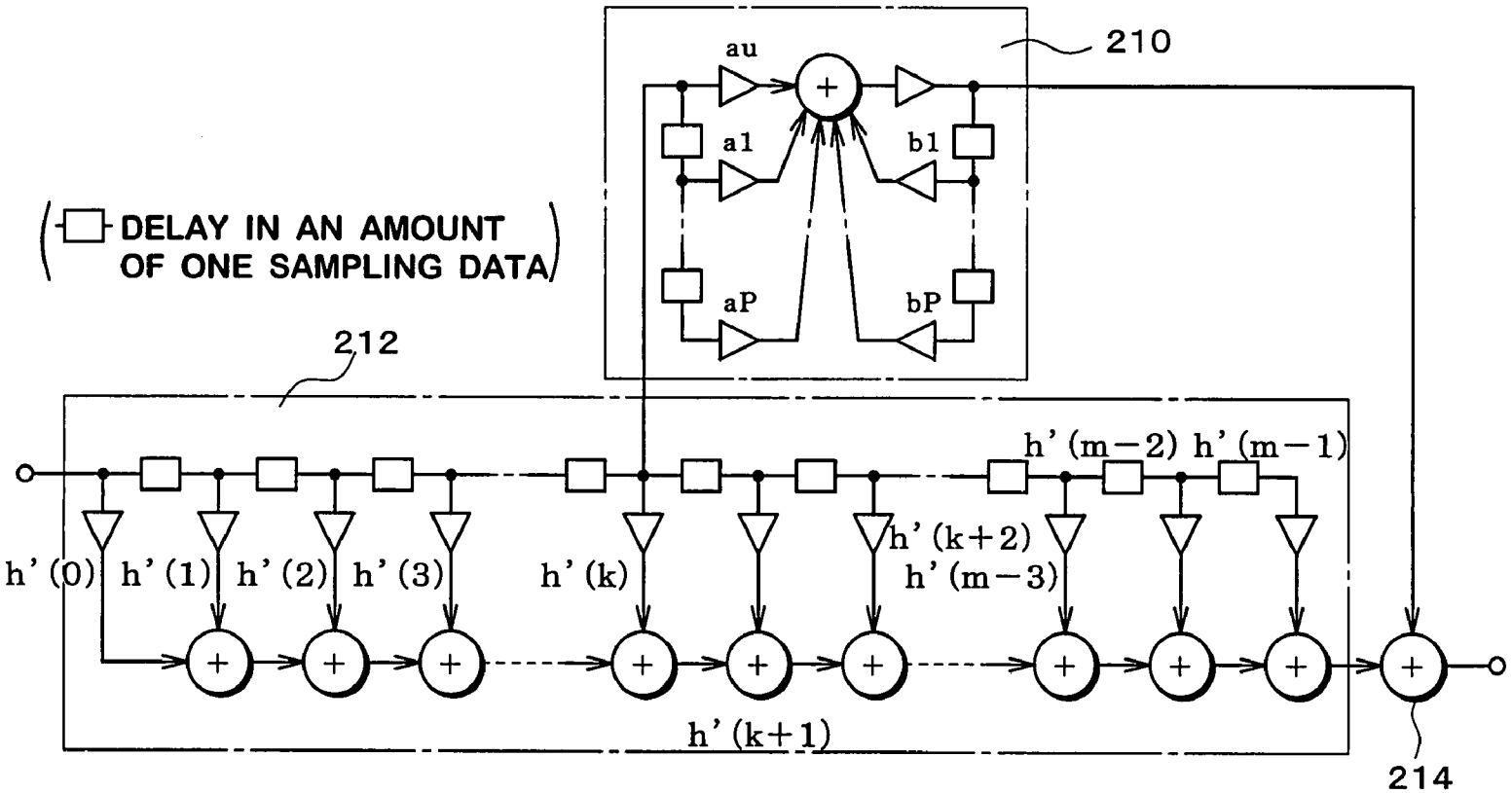
FIG. 24 is a signal-flow diagram according to an embodiment wherein an intermediate tap of FIR filter is connected to an input of IIR filter.

According to the embodiment shown in FIG. 22, the second filter 120*b*, which is composed of parallel connection of the FIR filter and the secondary IIR filter, is exemplified. However, as shown in FIG. 24, one of intermediate taps of the FIR filter can be connected to the input of the secondary IIR filter. The end tap (i.e., the tap of the number m−1 in FIG. 24) may also be connected to the input of the secondary IIR filter. As a result, properties of the second filter 120*b* can be easily varied depending upon the desired properties.

Figure 25:
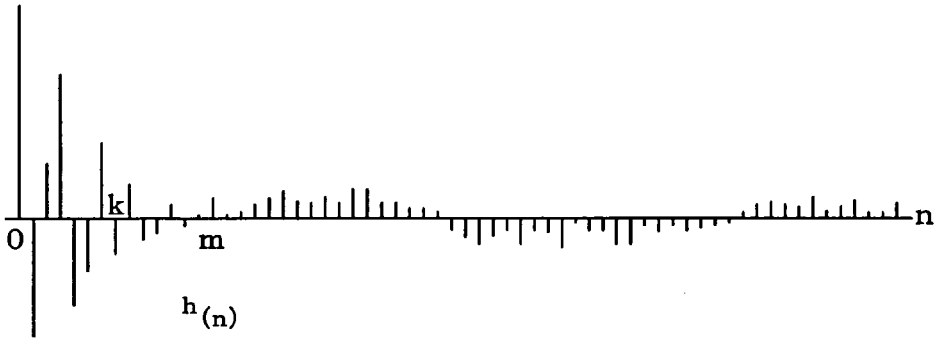
FIG. 25 is a graph illustrating a desired impulse response for the second filter.
Figure 26:
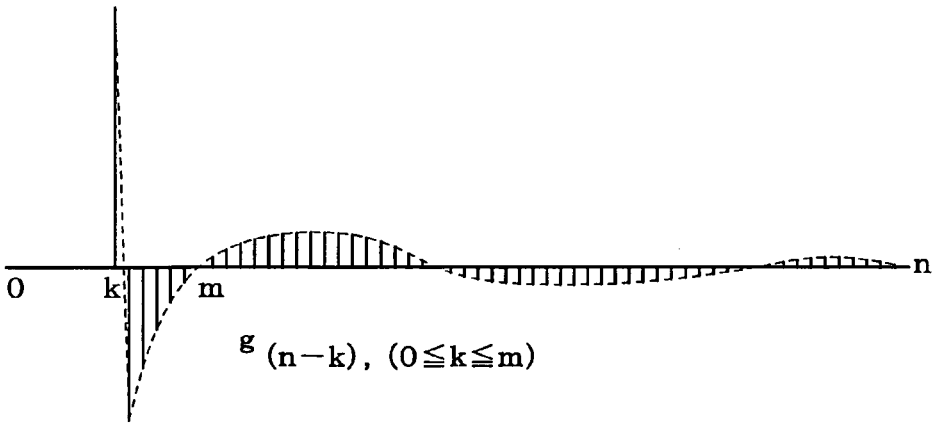
FIG. 26 is a graph illustrating an impulse response of IIR filter having properties approximate to that of FIG. 25.
Figure 27:
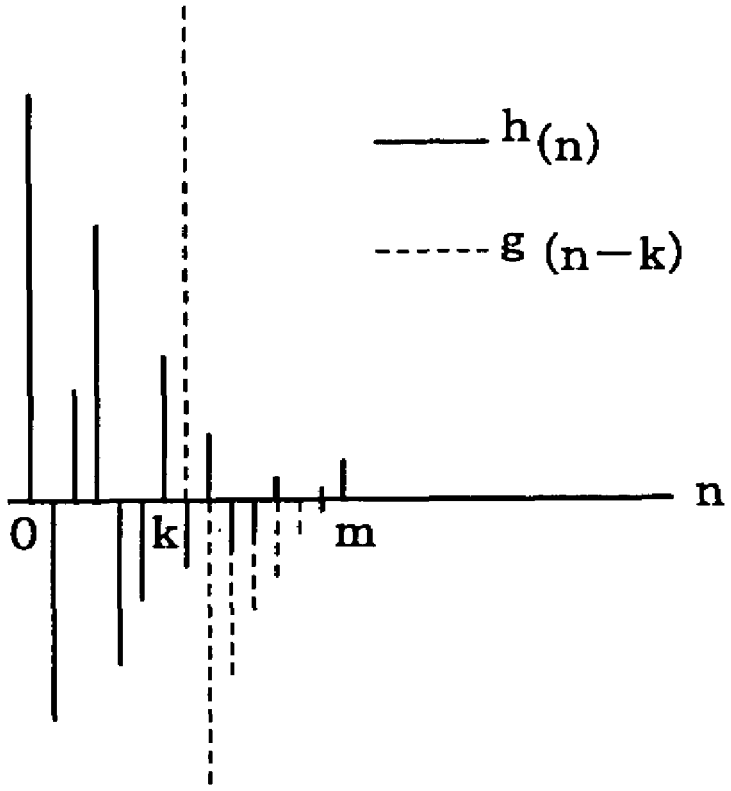
FIG. 27 is a graph illustrating a deviation of the impulse response of the IIR filter from the desired impulse response.

Hereinafter, a design method of the filter shown in FIG. 24 will be described with reference to FIGS. 25 to 28. FIG. 25 shows an impulse response required for the second filter 120*b*. Based on the required impulse response, an impulse response of the secondary IIR filter is decided. Initially, the impulse response is decided by preferentially approximating it to the latter part of the required impulse response (which corresponds to a low frequency region), as shown in FIG. 26. In the example of FIG. 26, the impulse response of the secondary IIR filter having the property approximate to that of the required impulse response after the sample of the number k is obtained. It is noted that; with respect to the sample of the number k to the sample of the number m, the impulse response of the secondary IIR filter is largely deviated from the required impulse response.

Figure 28:
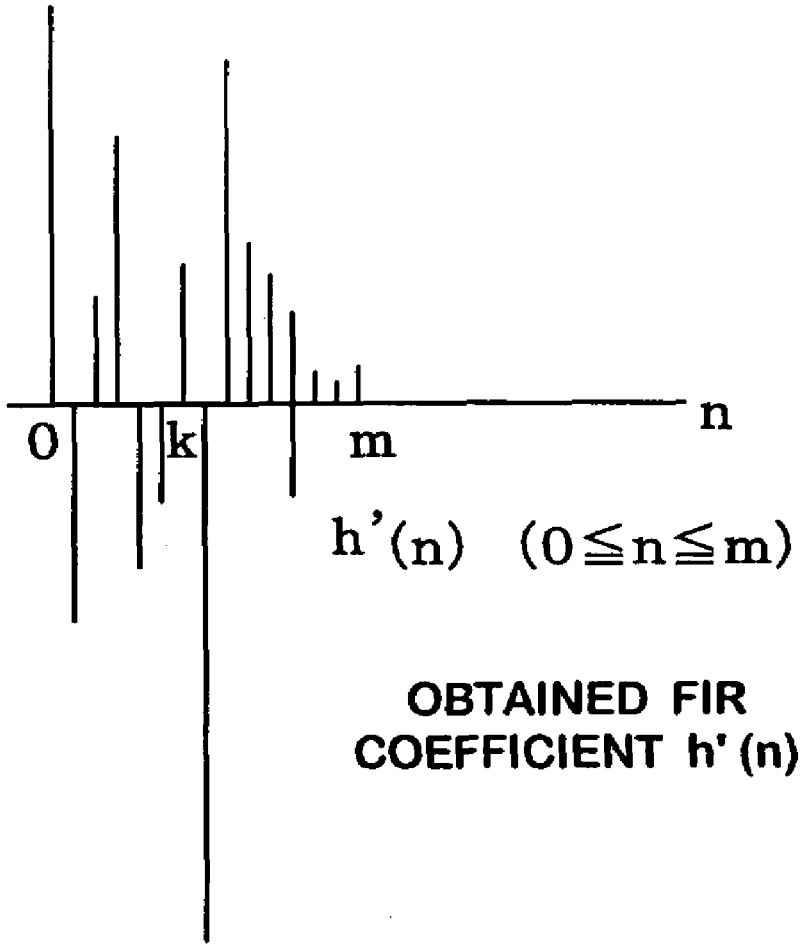
FIG. 28 is a graph illustrating an impulse response of FIR filter obtained in due consideration of the deviation of FIG. 27.
Figure 29:
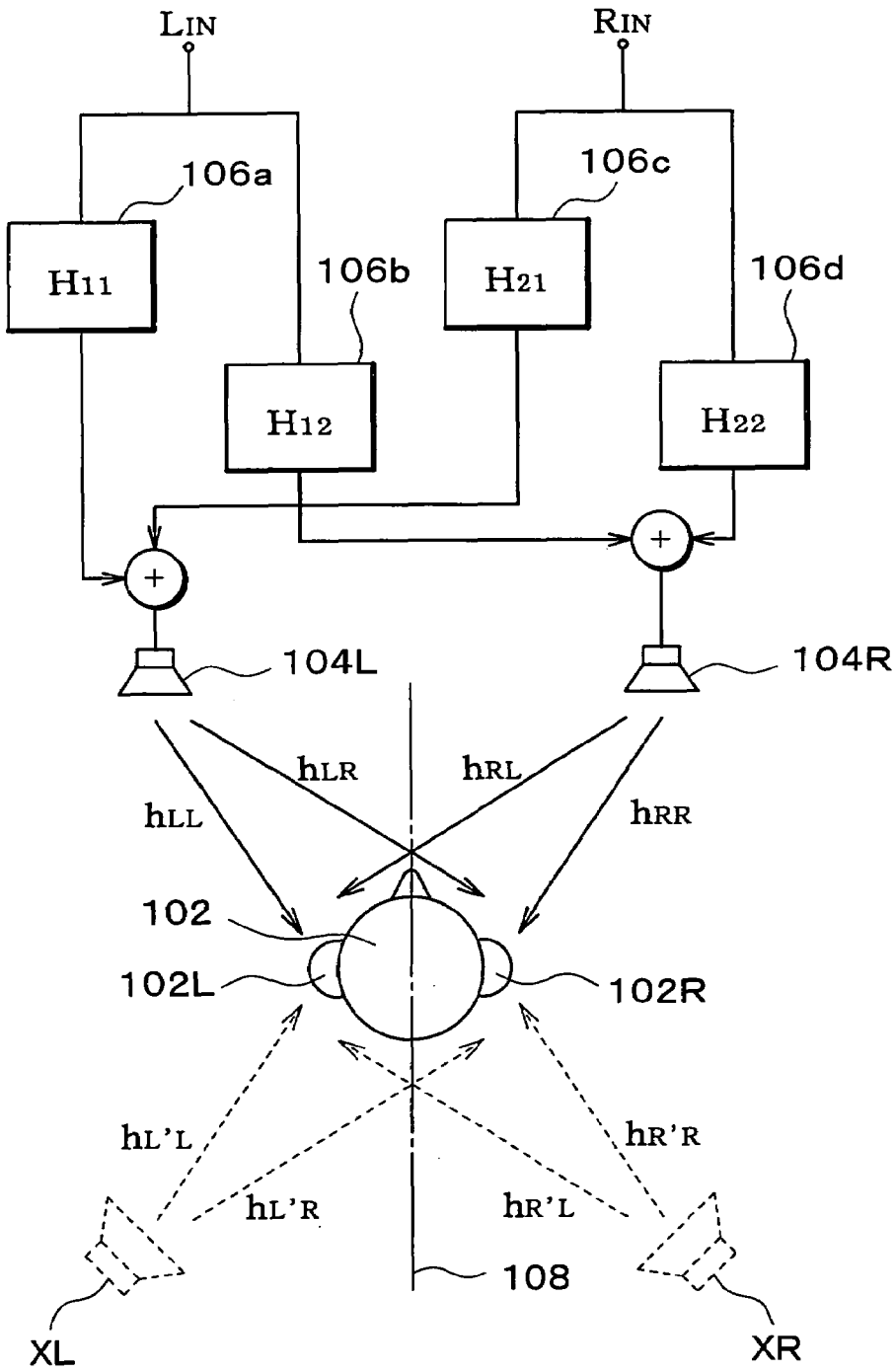
FIG.29 (PRIOR ART)
FIG. 29 is a schematic view illustrating conventional sound image localization technique.
Figure 30:
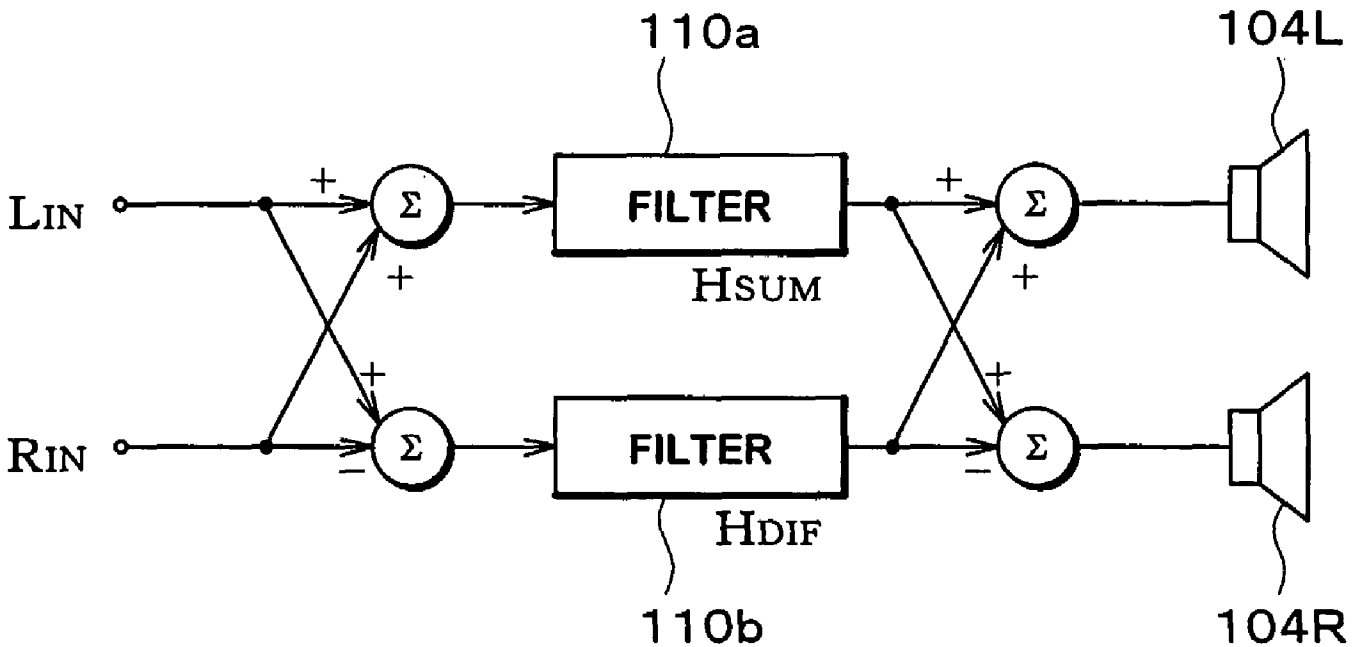
FIG. 30 is a circuit diagram illustrating shuffler type filter.
Figure 31:
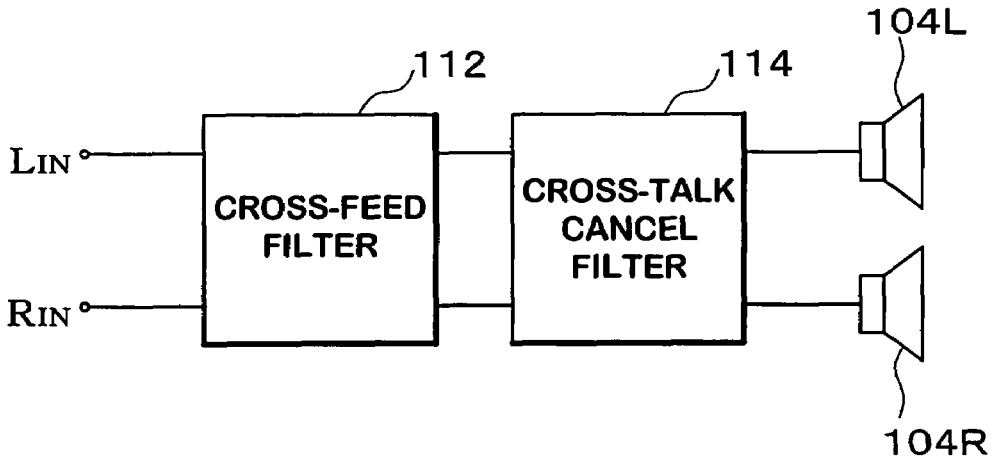
FIG. 31 is a block diagram of a sound image localization circuit including a cross-feed filter and a cross-talk cancel filter.

Next, the impulse response of the FIR filter is obtained with respect to the sample of the number zero to the sample of the number m. As described above and as shown in FIG. 27, the impulse response of the secondary IIR filter is largely deviated from the required impulse response with respect to the sample of the number k to the sample of the number m. In consideration of such a deviation, the impulse response of the FIR filter as shown in FIG. 28 is obtained with respect to the sample of the number zero to the sample of the number m.

As described above, the second filter 120*b* as shown in FIG. 24 can be obtained. The intermediate tap connected to the input of the secondary IIR filter is the tap corresponding to the first sample from which the approximation is conducted (i.e., the sample of the number k in the above-mentioned example). As described above, a filter having a desired impulse response can be easily obtained.

In the above embodiments, the tap number has been described only for being exemplified. Furthermore, the cross-talk cancel filter has been described in the above embodiments, however, the present invention is applicable to a sound image localization filter.

In the above embodiments, FIR filter is used for the first filter 120*a*. However, the first filter 120*a* may also be composed of a parallel connection of FIR filter and IIR filter (as shown in FIGS. 22 and 24). Alternatively, the first filter 120*a* may employ a filter bank. Even in this case, when the second filter 120*b* having a higher accuracy than that of the first filter 120*a* is employed, a cross-talk cancel filter having a high accuracy can be obtained while keeping simple an overall structure of the filter.

In the above embodiments, although DSP is used in the cross-talk cancel filter, an analog filter may be entirely or partially substituted for the DSP.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An audio signal processing circuit for an audio reproduction apparatus at least having sound source located substantially at left and right sides to a listener, comprising:

a phase difference control portion which receives a left channel signal for the left sound source and a right channel signal for the right sound source, controls a phase difference between the left and right channel signals so as to produce a relative phase difference in the range of 140 degrees to 160 degrees, and outputs the phase difference controlled left and right channel signals for the left and right sound source, respectively, wherein said left sound source and said right sound source are positioned substantially same distances from the listener such that the produced relative phase difference in the range of 140 degrees to 160 degrees occurs at the location of the listener.

2. An audio signal processing circuit according to claim 1, wherein the phase difference control portion produces the relative phase difference of 140 degrees to 160 degrees in a frequency region ranging from 200 Hz to 1 kHz.

3. An audio signal processing circuit according to claim 1, wherein the phase difference control portion is a monophonic phase difference controller.

4. A surround audio reproduction apparatus having a left and a right channels in front of a listener and a left and a right surround channels at left and right sides with respect to the listener, comprising:

a phase difference control portion which receives a left surround channel signal and a right surround channel signal, controls a phase difference between the left and the right surround channel signals so as to produce a relative phase difference in the range of 140 degrees to 160 degrees, and outputs the phase difference controlled surround left and right channel signals for a left and a right surround sound source, respectively, wherein said left sound source and said right sound source are positioned substantially same distances from the listener such that the produced relative phase difference in the range of 140 degrees to 160 degrees occurs at the location of the listener.

5. A surround audio signal processing circuit according to claim 4, wherein the left and the right surround sound sources are a virtual sound source produced by a sound image localization processing.

6. A surround audio signal processing circuit according to claim 4, wherein the phase difference control portion produces the relative phase difference of 140 degrees to 160 degrees in a frequency region ranging from 200 Hz to 1 kHz.

7. A surround audio reproduction apparatus according to claim 4, wherein the phase difference control portion is a monophonic phase difference controller.

8. An audio reproduction method at least utilizing sound source located substantially at left and right sides to a listener, comprising the steps of:

controlling a phase difference between a left channel signal for the left sound source and a right channel signal for the right sound source so as to produce a relative phase difference in the range of 140 degrees to 160 degrees; and outputting the phase difference controlled left and right channel signals for the left and right sound source, respectively, wherein said left sound source and said right sound source are positioned substantially same distances from the listener such that the produced relative phase difference in the range of 140 degrees to 160 degrees occurs at the location of the listener.

9. An audio reproduction method according to claim 8, wherein the phase difference is controlled by a monophonic phase difference controller.

* * * * *

UNITED STATES PATENT AND TRADEMARK OFFICE

CERTIFICATE OF CORRECTION

PATENT NO. : 7,242,782 B1
APPLICATION NO. : 09/361734
DATED : July 10, 2007
INVENTOR(S) : Kasai et al.

It is certified that error appears in the above-identified patent and that said Letters Patent is hereby corrected as shown below:

On the Title page, item (73) insert --Onkyo Corporation (JP)--

Signed and Sealed this

Fourth Day of November, 2008

JON W. DUDAS
*Director of the United States Patent and Trademark Office*